US006033817A

United States Patent [19]

Yusa et al.

[11] Patent Number: 6,033,817

[45] **Date of Patent: *Mar. 7, 2000**

[54] TONER FOR DEVELOPING ELECTROSTATIC IMAGE AND IMAGE FORMING METHOD

[75] Inventors: Hiroshi Yusa, Machida; Motoo Urawa, Funabashi; Keita Nozawa, Shizuoka-ken; Yuki Karaki, Shizuoka-ken; Kazuo Maruyama, Mishima, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/902,320

[22] Filed: Jul. 29, 1997

[30] Foreign Application Priority Data

Jul. 31, 1996 [JP] Japan ..... 8-216859

[51] Int. Cl.[7] ..... G03G 9/087; G03G 9/083

[52] U.S. Cl. ..... 430/106.6; 430/110; 430/111; 430/126

[58] Field of Search ..... 430/126, 111, 430/109, 106, 110, 106.6

[56] References Cited

U.S. PATENT DOCUMENTS

| | | | |
|---|---|---|---|
| 5,219,697 | 6/1993 | Mori et al. | 430/110 |
| 5,270,143 | 12/1993 | Tomiyama et al. | 430/109 |
| 5,712,073 | 1/1998 | Katada et al. | 430/111 |

FOREIGN PATENT DOCUMENTS

| | | |
|---|---|---|
| 415727 | 3/1991 | European Pat. Off. . |
| 0445986 | 9/1991 | European Pat. Off. . |
| 0658816 | 6/1995 | European Pat. Off. . |
| 0681218 | 11/1995 | European Pat. Off. . |
| 0729075 | 8/1996 | European Pat. Off. . |
| 0730205 | 9/1996 | European Pat. Off. . |
| 61-279864 | 12/1986 | Japan . |
| 63-149669 | 6/1988 | Japan . |
| 63-235953 | 9/1988 | Japan . |
| 2-123385 | 5/1990 | Japan . |

*Primary Examiner*—John Goodrow
*Attorney, Agent, or Firm*—Fitzpatrick, Cella, Harper & Scinto

[57] ABSTRACT

A toner for developing an electrostatic image is disclosed which has at least one endothermic peak in the temperature region of 120° C. or below in differential thermal analysis and contains, in its particles having particle diameters of 3 μm or larger, not less than 93% by number of particles having a circularity of at least 0.90 and less than 30% by number of particles having a circularity of at least 0.98. The toner does not cause the re-transfer under high transfer current conditions and can realize the formation of good images with high image density. Also, an image forming method using the toner is disclosed.

213 Claims, 7 Drawing Sheets

Xμm ISOLATED DOTS

TONER FOR DEVELOPING ELECTROSTATIC IMAGE AND IMAGE FORMING METHOD

BACKGROUND OF THE INVENTION

1. Field of the Invention

This invention relates to a toner for developing an electrostatic image, and an image forming method, used in recording processes that utilize electrophotography, electrostatic recording, magnetic recording or the like. More particularly, this invention relates to a toner for developing an electrostatic image, and an image forming method, used in copying machines, printers, facsimile machines and so forth in which a toner image is previously formed on an electrostatic latent image bearing member and the toner image is thereafter transferred to a transfer medium to form an image.

2. Related Background Art

A number of methods are conventionally known for electrophotography. Final images such as copies or prints are commonly obtained by forming an electrostatic latent image on a photosensitive member by utilizing a photoconductive material and by various means, subsequently developing the electrostatic latent image by the use of a toner to make it visible to form a toner image, transferring the toner image to a transfer medium such as paper if necessary, and thereafter fixing the toner image to the transfer medium by heat, pressure or heat-and-pressure.

In recent years, there is an increasing demand for color image formation in image forming apparatus such as copying machines, printers and facsimile machines employing electrophotography. As color toners, non-magnetic toners are commonly used since it is difficult to use magnetic toners containing magnetic materials, in relation to their tints. In instances where a magnetic toner is used as a black toner and a non-magnetic toner is used as a color toner, optimum transfer current value of the non-magnetic toner tends to be higher than optimum transfer current value of the magnetic toner. If transfer conditions of the machinery main body are adjusted to the non-magnetic toner, the magnetic toner may cause a phenomenon called "re-transfer", in which the toner once transferred to a transfer medium returns onto the latent image bearing member, to cause a decrease in image density of black images.

In recent years, paper materials are being made available in greater variety, and hence the copying machines, printers and facsimile machines employing electrophotography are sought to be adaptable to such various paper materials. However, optimum transfer conditions may differ depending on paper materials serving as transfer medium. For example, cardboards and overhead projector films (OHP films) have a high optimum transfer current value and thin paper has a low optimum transfer current value. Hence, if the transfer conditions of the machinery main body are made optimum to cardboards or OHP film, the phenomenon of "re-transfer" may also occur when transferred to thin paper.

Japanese Patent Application Laid-open No. 61-279864 discloses a toner whose shape factors SF-1 and SF-2 are defined. However, this publication has no disclosure at all as to transfer. Also, as a result of experiments to follow up Examples, using toners described therein to carry out transfer, the toner has been found to have an insufficient transfer efficiency, and must be more improved.

Japanese Patent Application Laid-open No. 63-235953 also discloses a magnetic toner whose particles have been made spherical by a mechanical impact force. However, the toner still has an insufficient transfer efficiency, and must be more improved.

As printers, LED printers and LBP printers are prevailing in the recent market. As a trend of techniques, there is a tendency toward higher resolution. That is, those which hitherto have a resolution of 240 or 300 dpi are being replaced by those having a resolution of 400, 600 or 800 dpi. Accordingly, with such a trend, the developing systems are now required to achieve a higher minuteness.

Copying machines have also made progress to have higher functions, and hence they trend toward digital systems. The digital systems chiefly employ a method in which electrostatic latent images are formed by using a laser, and hence, the copying machines also trend toward a high resolution and, like the printers, it has been sought to provide a developing system with high resolution and high minuteness.

From such viewpoints, especially in the printers and copying machines of digital systems, their photosensitive layers are increasingly made thinner so that electrostatic latent images can be formed in a higher minuteness. When such thin-film photosensitive members are used, the electrostatic latent images have a low potential contrast, and hence toners used in development are desired to be toners having a higher developing performance.

In recent years, from the viewpoint of environmental protection, there is a tendency that, in place of the primary charging process and transfer process utilizing corona discharge as conventionally used, a primary charging process and a transfer process which employ a photosensitive member contact member is prevailing.

For example, proposals are disclosed in Japanese Patent Application Laid-open No. 63-149669 and No. 2-123385. These are concerned with a contact charging method and a contact transfer method. A conductive elastic charging roller is brought into contact with an electrostatic latent image bearing member, and the electrostatic latent image bearing member is uniformly electrostatically charged while applying a voltage to the conductive elastic roller, followed by exposure and developing steps to obtain a toner image. Thereafter, while another conductive elastic transfer roller to which a voltage is applied is pressed against the electrostatic latent image bearing member, a transfer medium is passed between the electrostatic latent image bearing member and the conductive elastic transfer roller to transfer to the transfer medium the toner image held on the electrostatic latent image bearing member, following by the step of fixing to obtain a transferred image.

However, in such a contact transfer system that utilizes no corona discharge, the transfer member such as a roller is brought into contact with the electrostatic latent image bearing member via the transfer medium at the time of transfer, and hence the toner image is pressed when the toner image formed on the electrostatic latent image bearing member is transferred to the transfer medium, so that a problem of partly faulty transfer tends to occur, which is called "blank areas caused by poor transfer".

In addition, as toners are made to have a smaller particle diameter, the attraction (image force, van der Waals force or the like) of toner particles to the electrostatic latent image bearing member becomes larger than the Coulomb force applied to the toner particles during transfer, so that the toner remaining untransferred tends to increase.

Moreover, in the roller transfer charging system, the physical and chemical action on the surface of the electrostatic latent image bearing member, attributable to the discharge caused between the charging roller and the electrostatic latent image bearing member, is larger than that in the corona charging system. Hence, especially when a combination of organic photosensitive member/blade cleaning is employed, the roller tends to wear because of a surface deterioration of the organic photosensitive member to cause a problem on its lifetime. However, when a combination of contact charging/organic photosensitive member/one-component magnetic development/contact transfer/blade cleaning is employed, the image forming apparatus can be made low-cost, and small-size and light-weight with ease. Thus, such a system is prevailing in copying machines, printers and facsimile machines in the field where low prices, and small size and light weight are needed.

Accordingly, toners and photosensitive members used in such image forming methods have been sought to have superior release properties.

SUMMARY OF THE INVENTION

An object of the present invention is to provide a toner for developing an electrostatic image, and an image forming method, that have solved the above problems in the prior art.

Another object of the present invention is to provide a toner for developing an electrostatic image, and an image forming method, that do not cause the "re-transfer" under broad transfer current conditions (especially under high transfer current conditions), and can attain a high image density.

Still another object of the present invention is to provide a toner for developing an electrostatic image, and an image forming method, that have a superior developing ability even on electrostatic latent images having a lower latent image contrast, achieve a high image density, and enable development faithful to minute spot latent images to obtain sharp images.

A further object of the present invention is to provide a toner for developing an electrostatic image, and an image forming method, that show a superior transfer performance, make less toner remain untransferred, and may cause no blank areas caused by poor transfer even in the roller transfer system or may less cause such a phenomenon.

A still further object of the present invention is to provide a toner for developing an electrostatic image, and an image forming method, that show superior releasability and slipperiness, these performances promising a long-lifetime image bearing member that may cause less photosensitive member wear even after printing over a long period of time on a large number of sheets.

A still further object of the present invention is to provide a toner for developing an electrostatic image, and an image forming method, that may cause no faulty charging and faulty images due to contamination of members coming into pressure contact with the electrostatic latent image bearing member, or may less cause such phenomena.

To achieve the above objects, the present invention provides a toner for developing an electrostatic image, comprising toner particles containing at least a binder resin and a colorant, and an inorganic fine powder, wherein;

the toner has at least one endothermic peak in the temperature region of 120° C. or below in differential thermal analysis; and the toner has, in its particles having particle diameters of 3 μm or larger, not less than 90% by number of particles having a circularity $\dot{a}$ of at least 0.90 and less than 30% by number of particles having a circularity $\dot{a}$ of at least 0.98, the circularity being found from the following expression (1):

$$\text{Circularity } \dot{a}=Lo/L \quad (1)$$

wherein Lo represents a circumferential length of a circle having the same projected area as a particle image, and L represents a circumferential length of a projected image of a particle.

The present invention also provides an image forming method comprising the steps of;

electrostatically charging an electrostatic latent image bearing member;

forming an electrostatic latent image on the electrostatic latent image bearing member thus charged;

developing the electrostatic latent image by the use of a toner carried on a toner carrying member, to form a toner image on the electrostatic latent image bearing member; and bringing a transfer member to which a voltage is applied, into contact with a transfer medium to transfer to the transfer medium the toner image held on the electrostatic latent image bearing member;

the toner comprising toner particles containing at least a binder resin and a colorant, and an inorganic fine powder, wherein;

the toner has at least one endothermic peak in the temperature region of 120° C. or below in differential thermal analysis; and the toner has, in its particles having particle diameters of 3 μm or larger, not less than 90% by number of particles having a circularity $\dot{a}$ of at least 0.90 and less than 30% by number of particles having a circularity $\dot{a}$ of at least 0.98, the circularity being found from the following expression (1):

$$\text{Circularity } \dot{a}=Lo/L \quad (1)$$

wherein Lo represents a circumferential length of a circle having the same projected area as a particle image, and L represents a circumferential length of a projected image of a particle.

The present invention still also provides an image forming method comprising the steps of;

electrostatically charging an electrostatic latent image bearing member;

forming an electrostatic latent image on the electrostatic latent image bearing member thus charged;

developing the electrostatic latent image by the use of a toner carried on a toner carrying member, to form a toner image on the electrostatic latent image bearing member;

primarily transferring the toner image held on the electrostatic latent image bearing member, to an intermediate transfer member; and bringing a transfer member to which a voltage is applied, into contact with a recording medium to secondarily transfer to the recording medium the toner image held on the intermediate transfer member;

the toner comprising toner particles containing at least a binder resin and a colorant, and an inorganic fine powder, wherein;

the toner has at least one endothermic peak in the temperature region of 120° C. or below in differential thermal analysis; and the toner has, in its particles having particle diameters of 3 μm or larger, not less than 90% by number of particles having a circularity $\dot{a}$ of at least 0.90 and less than 30% by number of particles having a circularity $\dot{a}$ of at least 0.98, the circularity being found from the following expression (1):

$$\text{Circularity } \dot{a}=Lo/L \quad (1)$$

wherein Lo represents a circumferential length of a circle having the same projected area as a particle image, and L represents a circumferential length of a projected image of a particle.

DESCRIPTION OF THE PREFERRED EMBODIMENTS

Figure 1:
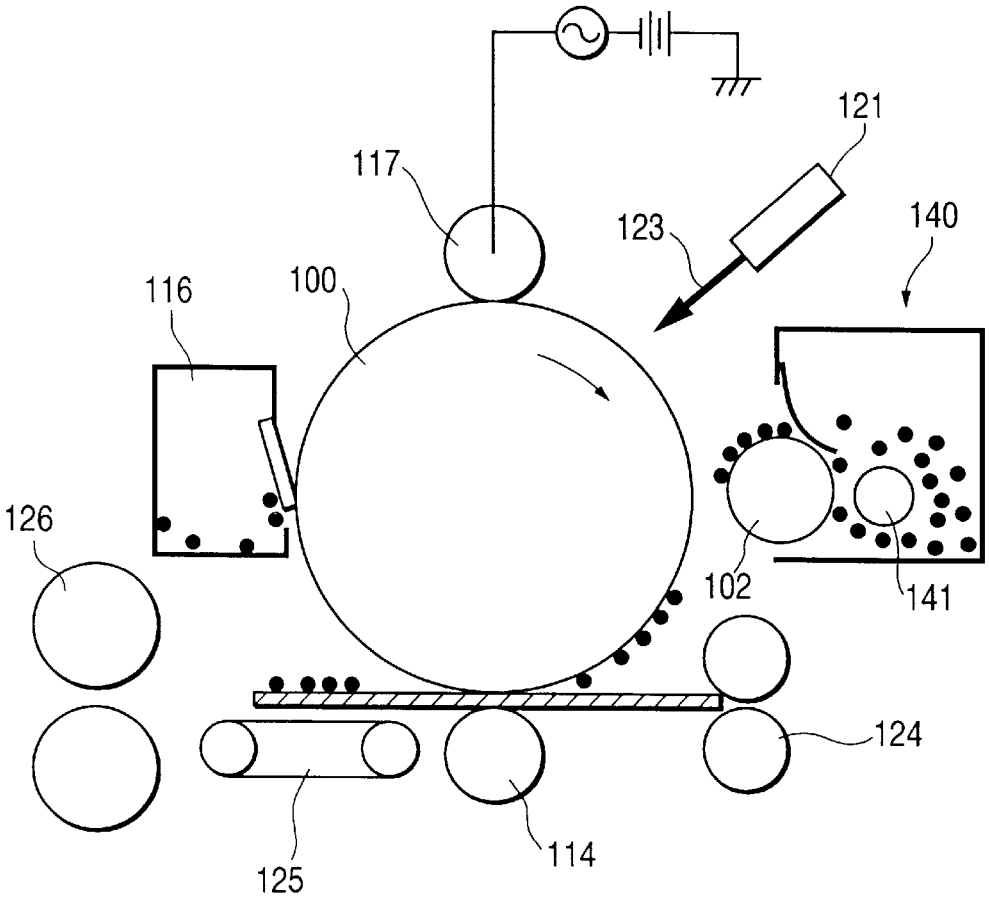
FIG. 1 is a schematic illustration showing an example of an image forming apparatus preferred in the present invention.

The circularity referred to in the present invention is used as a simple way to quantitatively describe the shape of particles. In the present invention, measurement is made using a flow type particle image analyzer FPIA-1000, manufactured by Toa Iyoudenshi K.K., and a value found from the following expression (1) is defined to be the circularity.

$$\text{Circularity } \dot{a}=Lo/L \quad (1)$$

wherein Lo represents a circumferential length of a circle having the same projected area as a particle image, and L represents a circumferential length of a projected image of a particle.

As a specific way of measurement, from 0.1 to 0.5 ml of a surface active agent, preferably an alkylbenzenesulfonate, is added as a dispersant in from 100 to 150 ml of water in a container, from which impurity solid matter has been removed, and a sample for measurement is further added in an amount of from about 0.1 to 0.5 g. A suspension in which the sample has been provisionally dispersed is subjected to dispersion treatment for about 1 to 3 minutes by means of an ultrasonic dispersion mixer to obtain a dispersion with a concentration of from 3,000 to 10,000 particles/μl, where the shape and particle size of toner particles are measured using the above analyzer.

The circularity referred to in the present invention is an index of the degree of irregularities in the surface of a toner particle. It is indicated as 1.00 when a toner particle is perfectly spherical, and the circularity is indicated by a smaller value as the surface has a more complicated shape.

In the present invention, as standard deviation SD of circularity distribution, a value is also used which is found from the following expression (2) on the basis of circularity of each particle and average circularity.

$$\text{Standard deviation } SD = \sqrt{\sum (a_i - \bar{a})^2 / (n-1)} \quad (2)$$

wherein $a_i$ represents a circularity of of each particle, $\bar{a}$ represents an average circularity, and n represents the number of whole particles.

The SD of circularity distribution referred to in the present invention is an index of the breadth of distribution, and indicates that, the smaller the numerical value is, the more free of scattering and sharper the distribution is.

The present inventors examined the relationship between circularity distribution of toner particles and transfer performance. As a result, they have discovered that these very deeply correlate, and have accomplished the present invention.

The toner of the present invention may preferably have, in its particles having particle diameters of 3 μm or larger, not less than 90% by number (from 90 to 100% by number), and more preferably not less than 93% by number (from 93 to 100% by number), of particles having a circularity $\dot{a}$ of at least 0.90 and less than 30% by number (from 0 to less than 30% by number) of particles having a circularity $\dot{a}$ of at least 0.98, and may more preferably have, in its particles having particle diameters of 3 μm or larger, a standard deviation SD of circularity distribution, of 0.045 or less ($0<SD\leqq 0.045$), and more preferably 0.040 or less ($0<SD\leqq 0.040$), whereby the problems previously discussed can be solved without any difficulty.

If the particles having a circularity $\dot{a}$ of at least 0.90 are in a content less than 90% by number in the toner, the transfer efficiency may lower when toner images are transferred from the electrostatic latent image bearing member to the transfer medium, and blank areas caused by poor transfer may occur in characters or lines, undesirably. Also, if the particles having a circularity $\dot{a}$ of at least 0.98 are in a content more than 30% by number in the toner, faulty cleaning tends to occur.

Much superior transfer performance can be also attained when the standard deviation SD of circularity distribution in the toner particles having particle diameters of 3 μm or larger is 0.045 or less.

The reason therefor is that, when a thin layer of toner is formed on the toner carrying member in the step of development, the toner coat can be kept in a sufficient quantity even if the toner layer thickness control member is set at a stronger control force than usual and hence the charge quantity of toner on the toner carrying member can be made higher than usual without causing damage to the toner carrying member.

For this reason, the ability to develop low-potential latent images having an electrostatic latent image potential contrast of 400 V or below or still lower 350 V or below, which has been hitherto difficult to improve, can be greatly improved. This is effective especially when minute spot latent images of a digital system are developed.

In addition, at the same time, even in the case of magnetic toners, it becomes easy to achieve a high image density without causing "re-transfer" under the same broad transfer current conditions as non-magnetic toners (especially under high transfer current conditions).

Magnetic toners commonly have a lower resistance than non-magnetic toners, and the transfer current conditions are set a little lower in respect of the magnetic toners and a little higher in respect of the non-magnetic toners.

In recent years, as a method of forming full-color images, a combination attracts notice in which a black toner is a magnetic toner, which has a superior running stability in monochrome and can be made long-lifetime with ease, and other color toners are non-magnetic toners.

When the present invention is applied in the magnetic toner or in both the magnetic toner and the non-magnetic toner in the full-color image forming method employing a magnetic toner and non-magnetic toners in combination, it becomes possible to set substantially the same transfer current conditions as those for non-magnetic toners.

In an image forming method employing an intermediate transfer member as will be detailed later, the toner constituted according to the present invention is used as a magnetic toner, and this magnetic toner is used together with at least one non-magnetic color toner selected from the group consisting of a non-magnetic cyan toner, a non-magnetic yellow toner and a non-magnetic magenta toner, where toner images are successively primarily transferred from an electrostatic latent image bearing member onto the intermediate transfer member, and a color toner image formed of a combination of the magnetic toner and non-magnetic color toner(s) primarily transferred onto the intermediate transfer member is transferred to a recording medium at one time. Thus, in such an instance, the faulty transfer may hardly occur even when toner images are transferred under a little higher transfer current conditions suited for non-magnetic color toners, because the magnetic toner is well transferred like the non-magnetic color toners.

The toner of the present invention has at least one endothermic peak in the temperature region of 120° C. or below, and preferably in the temperature region of 110° C. or below, in differential thermal analysis of the toner.

If the endothermic peak in differential thermal analysis of the toner is not present in the temperature region of 120° C. or below, the present invention can not be well effective.

More specifically, in the toner having an endothermic peak in the temperature region of 120° C. or below in differential thermal analysis of the toner, different from toners not having an endothermic peak in the temperature region of 120° C. or below, the state of dispersion of a magnetic material and a charge control agent in a binder resin is presumed to come to be "a certain unusual state" in the step of melt kneading in its production process. This certain unusual state is presumed to affect the surface properties of toner particles used in the present invention to bring about a state in which the effect of improving transfer performance is brought out with ease.

More specifically, since the toner has an endothermic peak in the temperature region of 120° C. or below in differential thermal analysis of the toner, the above specific circularity distribution of the toner can be achieved with ease. Especially when a mechanical impact must be imparted to the toner in order to achieve the above specific circularity distribution, there is the effect of appropriately maintaining the temperature rise in the production apparatus, and hence appropriate surface properties of toner particles can be attained without causing any melt-adhesion of toner to the apparatus.

In the present invention, the toner is effective so long as it has at least one endothermic peak in the temperature region of 120° C. or below in differential thermal analysis of the toner. It may also have other endothermic peak in the temperature region exceeding 120° C. In the present invention, it is more preferable for the toner not to have an endothermic peak in the temperature region of 60° C. or below, and preferably in the temperature region of 70° C. or below, in differential thermal analysis of the toner. If the toner has an endothermic peak in the temperature region of 60° C. or below in differential thermal analysis of the toner, the image density tends to decrease and also the storage stability tends to become uncertain.

As a means for bringing the toner into the form of having at least one endothermic peak in the temperature region of 120° C. or below in differential thermal analysis of the toner, it is preferable to use a method in which a compound having an endothermic peak in the temperature region of 120° C. or below in differential thermal analysis is internally added in the toner.

The compound or substance having at least one endothermic peak in the temperature region of 120° C. or below in differential thermal analysis may include resins or waxes.

The resins may include polyester resins and silicone resins both having a crystallinity.

The waxes may include petroleum waxes such as paraffin wax, microcrystalline wax and petrolatum wax, and derivatives thereof; montan wax and derivatives thereof; hydrocarbon waxes obtained by the Fischer-Tropsch process, and derivatives thereof; polyolefin waxes as typified by polyethylene, and derivatives thereof; natural waxes such as carnauba wax and candelilla wax, and derivatives thereof; alcohols such as higher aliphatic alcohols; fatty acids such as stearic acid and palmitic acid, and derivatives thereof; acid amides, esters and ketones, and derivatives thereof; hardened castor oil and derivatives thereof; vegetable waxes; and animal waxes. The derivatives may include oxides, and block copolymers or graft modified products with vinyl monomers.

Of these, polyolefins, Fischer-Tropsch process hydrocarbon waxes, petroleum waxes or higher alcohols are particularly preferred in the toner of the present invention because they have the effect of stabilizing the charging of the toner matrix and enhance the effect of preventing "re-transfer".

The use of the above specific compound makes higher the effect of preventing "re-transfer".

These compounds have a relatively low polarity in themselves, and are presumed to stabilize the charging of toner.

The "re-transfer" can be prevented more effectively when the compound having an endothermic peak in the temperature region of 120° C. or below in differential thermal analysis is a wax selected from the group consisting of polyolefins, Fischer-Tropsch process hydrocarbon waxes, petroleum waxes and higher alcohols and has a ratio of weight-average molecular weight (Mw) to number average molecular weight (Mn) as measured by GPC, Mw/Mn, of from 1.0 to 2.0, and preferably from 1.0 to 1.5.

It is presumed that the incorporation of the wax having a ratio of weight-average molecular weight (Mw) to number average molecular weight (Mn), Mw/Mn, of from 1.0 to 2.0, having a fairly sharp molecular weight distribution, makes more preferable the state of dispersion of a magnetic material and a charge control agent in a binder resin in the step of melt kneading in the production of the toner.

The endothermic peak of the toner according to the present invention is measured using a DSC curve measured by, e.g., a differential scanning calorimeter of a high-precision inner heat input compensation type, such as DSC-7, manufactured by Parkin Elmer Co.

It is measured according to ASTM D3418-82. As the DSC curve used in the present invention, a DSC curve is used which is measured when the temperature of a sample is once raised to previously take a history, and the temperature is dropped and raised at a temperature rate of 10° C./min within the range of temperatures of from 0 to 200° C.

The endothermic peak temperature means a peak temperature in the direction of plus in the DSC curve, i.e., refers to the point at which the differential value of a peak curve becomes 0 where it turns from plus to minus.

In the present invention, as the binder resin used in the toner, a main peak of molecular weight in its molecular weight distribution as measured by GPC (gel permeation chromatography) may be present in a molecular weight region exceeding a molecular weight of 15,000. This is preferable for controlling the standard deviation of circularity distribution of the toner. More preferably, a component having a molecular weight of not more than 10,000 may preferably be in a proportion of 25% or less, and more preferably 20% or less.

If, in the molecular weight distribution of the binder resin of the toner as measured by GPC, the main peak is present in a molecular weight region of not more than a molecular weight of 15,000, or the component having a molecular weight of not more than 10,000 is in a proportion of more than 25%, the toner tends to become brittle against mechanical impact and tends to be excessively pulverized, and hence the circularity distribution of the toner may become broad to tend to make it difficult to control its value within the range prescribed in the present invention. Also, members with which the toner comes into contact, such as the electrostatic latent image bearing member, tend to be contaminated because of melt-adhesion of toner, tending to cause faulty charging and faulty images.

Especially when toner particles are made spherical by applying a mechanical impact after their pulverization, the binder resin whose main peak in its molecular weight distribution is present in a molecular weight region exceeding a molecular weight of 15,000 makes it possible to keep the circularity of toner particles uniform to a certain extent at the time the step of pulverization is completed. This is preferable in view of transfer performance because, in the processing subsequently carried out to make toner particles spherical, it becomes easy to control the circularity distribution within the range prescribed in the present invention, and also preferable in view of improvement in running performance because the members with which the toner comes into contact, such as the electrostatic latent image bearing member, can be prevented from being contaminated because of melt-adhesion of toner.

The binder may have in its molecular weight distribution no peak or shoulder in a molecular weight region of not more than a molecular weight of 15,000. This is more preferable because any ultrafine powder which may adversely affect development can be prevented from being formed in the step of making toner particles spherical where the mechanical impact is applied.

Figure 5:
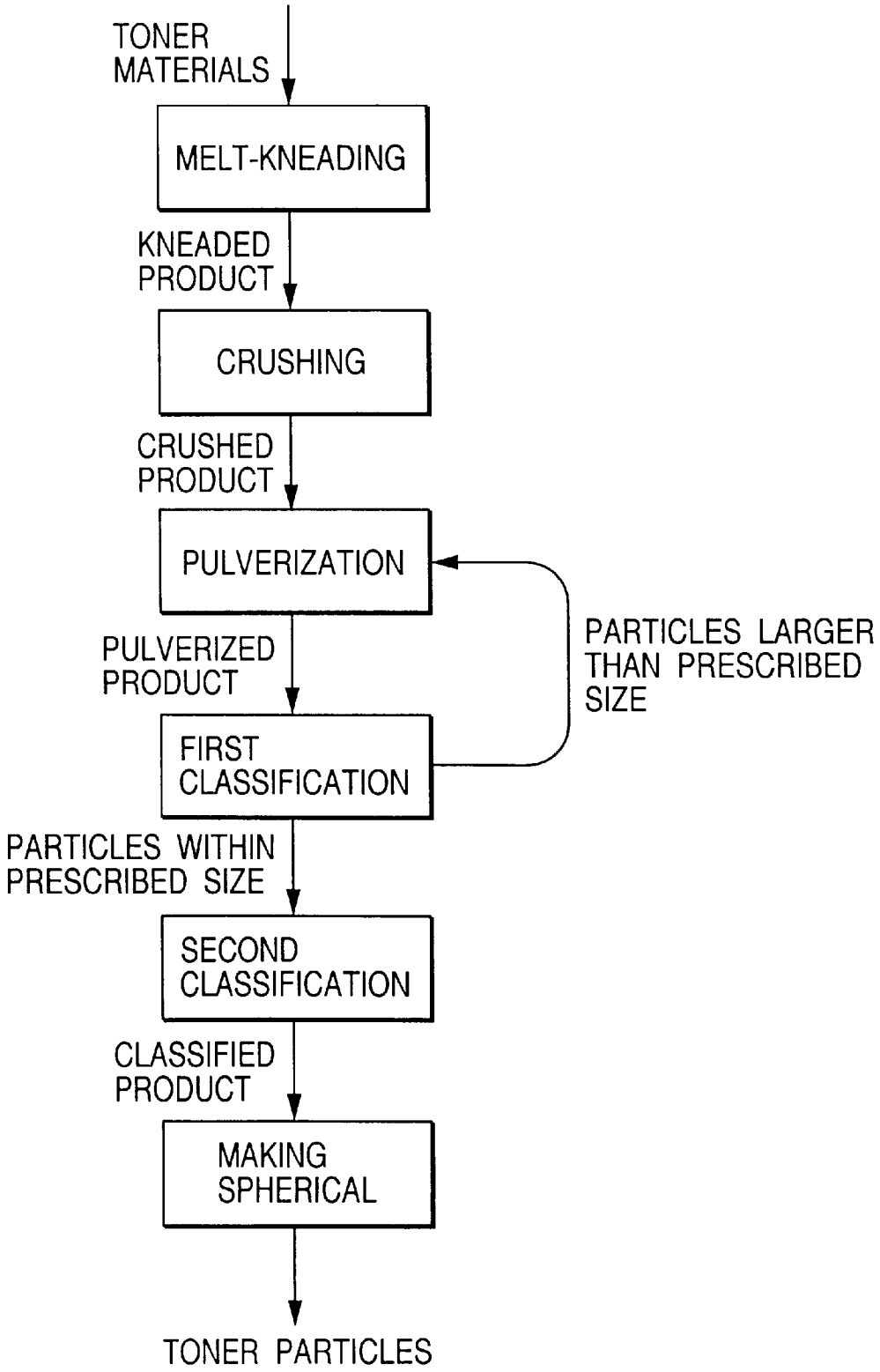
FIG. 5 is a chart showing an example of toner production steps (pulverization) preferred to obtain the toner of the present invention.

More specifically, the toner of the present invention is produced by a production process in which, as shown in FIG. 5, toner materials are melt-kneaded in the step of melt-kneading, the kneaded product is crushed in the step of crushing, the crushed product is finely ground in the step of pulverization, the pulverized product is classified in the step of first classification into particles within the stated prescribed particle diameters and particles larger than the prescribed particle diameters, the particles within the prescribed particle diameters among the classified particles are further classified in the step of second classification to obtain only particles having particle diameters within the stated range, the classified product having particle diameters within the stated range is made spherical by processing them in the step of making spherical, and meanwhile the particles larger than the prescribed particle diameters so classified in the step of first classification is again fed into the step of pulverization to repeat the subsequent steps.

In such a production process, in the case of the toner containing such a hard binder resin whose main peak in molecular weight distribution as measured by GPC of the binder resin in the toner is present in a molecular weight region exceeding a molecular weight of 15,000, the toner particles can be pulverized with difficulty in the step of pulverization, and hence many particles are again returned to the step of pulverization after toner particles are classified in the step of first classification. In usual cases, such particles are several times repeatedly fed into the step of pulverization.

As a result of repeating several times the step of pulverization, the classified product is appropriately made spherical before it is fed into the step of making spherical, and is also brought into a state where the circularity has been appropriately made uniform. Hence, the circularity distribution of the toner obtained after the subsequent step of making spherical can be preferably controlled within the range prescribed in the present invention. Especially in the case of toners having small particle diameter, the circularity can be better made uniform because toner particles are returned to the step of pulverization in a larger number of times.

In the present invention, the molecular weight of the binder resin in the toner is measured by GPC (gel permeation chromatography). As a specific method for measurement by GPC, the toner is beforehand extracted with THF (tetrahydrofuran) for 20 hours by means of a Soxhlet extractor. Using the sample thus obtained, and connecting as column constitution A-801, A-802, A-803, A-804, A-805, A-806 and A-807, available from Showa Denko K.K., the molecular weight distribution can be measured using a calibration curve of a standard polystyrene resin.

As the binder resin used in the present invention, it is possible to use, e.g., styrene and homopolymers of its substitution products, such as polystyrene, poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. A cross-linked styrene resin is also a preferred binder resin.

Comonomers copolymerizable with styrene monomers in the styrene copolymers may include monocarboxylic acids having a double bond and substitution products thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and substitution products thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether. Any of these vinyl monomers may be used alone or in combination.

Here, as a cross-linking agent, a compound having at least two polymerizable double bonds may be used. For example, it may include aromatic divinyl compounds as exemplified by divinyl benzene and divinyl naphthalene; carboxylic acid esters having two double bonds as exemplified by ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

As a binder resin for the toner, when used in pressure fixing, it may include low-molecular weight polyethylene, low-molecular weight polypropylene, an ethylene-vinyl acetate copolymer, an ethylene-acrylate copolymer, higher fatty acids, polyamide resins and polyester resins. Any of these may preferably be used either alone or in combination.

In the toner of the present invention, a charge control agent may preferably be used by compounding it into toner particles (internal addition) or blending it with toner particles (external addition). The charge control agent enables control of optimum charge quantity in conformity with developing systems. Especially in the toner of the present invention, it can make more stable the balance between particle size distribution and charge quantity. Negative charge control agents for controlling the toner to be negatively chargeable may include the following materials.

For example, organic metal complexes or chelate compounds are effective. They include monoazo metal complexes, acetylacetone metal complexes, aromatic hydroxycarboxylic acid metal complexes, and aromatic dicarboxylic acid metal complexes. Besides, they include aromatic hydroxycarboxylic acids, aromatic monocarboxylic acid, aromatic polycarboxylic acids, and metal salts, anhydrides or esters thereof, and phenol derivatives such as bisphenol.

Positive charge control agents for controlling the toner to be positively chargeable may include the following materials.

For example, Nigrosine and products modified with a fatty acid metal salt; quaternary ammonium salts such as tributylbenzylammonium 1-hydroxy-4-naphthoslulfonate and tetrabutylammonium teterafluoroborate, and analogues of these, including onium salts such as phosphonium salts and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate.

Any of these charge control agents may be used alone or in combination of two or more kinds.

The charge control agents described above may preferably be used in the form of fine particles. These charge control agents may preferably have a number average particle diameter of 4 $\mu$m or smaller, and particularly preferably 3 $\mu$m or smaller. In the case when the charge control agent is internally added to the toner, it may preferably be used in an amount of from 0.1 to 20 parts by weight, and particularly from 0.2 to 10 parts by weight, based on 100 parts by weight of the binder resin.

With regard to the colorant used in the present invention, black colorants may include carbon black, magnetic materials, and colorants so combined as to be toned in black by chromatic colorants such as the yellow colorant, magenta colorant and cyan colorant shown below.

The yellow colorant includes compounds as typified by condensation azo compounds, isoindolinone compounds, anthraquinone compounds, azo metal complexes, methine compounds and allylamide compounds. Stated specifically, C.I. Pigment Yellow 12, 13, 14, 15, 17, 62, 74, 83, 93, 94, 95, 97, 109, 110, 111, 120, 127, 128, 129, 147, 168, 174, 176, 180 and 191 are preferably used.

The magenta colorant includes condensation azo compounds, diketopyrrolopyrrole compounds, anthraquinone compounds, quinacridone compounds, basic dye lake compounds, naphthol compounds, benzimidazolone compounds, thioindigo compounds and perylene compounds. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferable.

The cyan colorant includes copper phthalocyanine compounds and derivatives thereof, anthraquinone compounds and basic dye lake compounds. Stated specifically, C.I. Pigment Blue 1, 7, 15, 15:1, 15:2, 15:3, 15:4, 60, 62 and 66 may be particularly preferably used.

These colorants may be used alone, in the form of a mixture, or in the state of a solid solution. In the present invention, the colorants are selected taking account of hue angle, chroma, brightness, weatherability, transparency on OHP films and dispersibility in toner particles. Any of these chromatic colorants may be contained in the toner in an amount of from 1 to 20 parts by weight based on 100 parts by weight of the binder resin.

The magnetic material includes metal oxides containing an element such as iron, cobalt, nickel, copper, magnesium, manganese, aluminum or silicon. In particular, those mainly composed of an iron oxide such as triiron tetraoxide or $\gamma$-iron oxide are preferred. In view of the control of charging performance of the toner, the magnetic material may contain another element such as silicon element or aluminum element. These magnetic materials may have a BET specific surface area, as measured by nitrogen gas absorption, of from 2 to 30 $m^2/g$, and particularly from 3 to 28 $m^2/g$, and may preferably magnetic materials having a Mohs hardness of from 5 to 7.

As to the shape of the magnetic material, it may be octahedral, hexahedral, spherical, acicular or flaky. Shapes having less anisotropy such as octahedral, hexahedral, spherical and amorphous are preferred in view of an improvement in image density.

The magnetic material may preferably have an average particle diameter of from 0.05 to 1.0 $\mu$m, more preferably from 0.1 to 0.6 $\mu$m, and still more preferably from 0.1 to 0.4 $\mu$m.

The magnetic material may preferably be in a content of from 30 to 200 parts by weight, more preferably from 40 to 200 parts by weight, and still more preferably from 50 to 150 parts by weight, based on 100 parts by weight of the binder resin. If it is in a content less than 30 parts by weight, the transport performance may be insufficient to tend to make the toner layer on the toner carrying member uneven and cause uneven images in the case of developing assemblies where a magnetic force is utilized to transport the toner. Also, the quantity of triboelectricity of the toner may increase to tend to cause a decrease in image density. If it is in a content more than 200 parts by weight, the fixing performance tends to come into question.

In the present invention, as the inorganic fine powder contained in the toner together with the toner particles, known materials may be used. In order to improve charge stability, developing performance, fluidity and storage stability, it may preferably be selected from fine silica powder, fine alumina powder, fine titania powder, and fine powders of double oxides thereof. Fine silica powder is more preferred. Silica includes what is called dry-process silica or fumed silica, produced by vapor phase oxidation of silicon halides or alkoxides, and what is called wet-process silica, produced from alkoxides or water glass, either of which can be used. The dry-process silica is preferred, as having less silanol groups on the surface and the inside of fine silica powder and leaving less production residue such as $Na_2O$ and $SO_3^{2-}$. In the dry-process silica, it is also possible to use, in its production step, another metal halide such as aluminum chloride or titanium chloride together with the silicon halide to give a composite fine powder of silica with another metal oxide. Such powders may also be included.

The inorganic fine powder used in the present invention may have a specific surface area, as measured by the BET method using nitrogen gas absorption, of 30 $m^2/g$ or above, and particularly ranging from 50 to 400 $m^2/g$, where good results can be obtained. The fine silica powder may preferably be contained in the toner in an amount of from 0.1 to 8 parts by weight, more preferably from 0.5 to 5 parts by weight, and still more preferably from more than 1.0 to 3.0 parts by weight, based on 100 parts by weight the toner particles.

For the purposes of making hydrophobic and controlling chargeability, the inorganic fine powder used in the present invention may preferably be treated, if necessary, with a treating agent such as silicone varnish, modified silicone varnish of various types, silicone oil, modified silicone oil of various types, a silane coupling agent, a silane coupling agent having a functional group, other organic silicon compound or an organic titanium compound. The treating agent may be used alone or in combination.

The BET specific surface area is determined by the BET method, where nitrogen is adsorbed on sample surfaces using a specific surface area measuring device AUTOSOBE 1 (manufactured by Yuasa Ionics Co.), and the specific surface area is calculated by the BET multiple point method.

In order for the toner to maintain a high charge quantity and achieve a low toner consumption and a high transfer efficiency, the inorganic fine powder may more preferably be treated with silicone oil.

In the toner of the present invention, other additives may also be used so long as they substantially do not adversely affect the toner. They may include lubricant powders as exemplified by Teflon powder, stearic acid zinc powder and polyvinylidene fluoride powder; abrasives such as cerium oxide powder, silicon carbide powder and strontium titanate powder; fluidity-providing agents as exemplified by titanium oxide powder and aluminum oxide powder; anti-caking agents; conductivity-providing agents as exemplified by carbon black powder, zinc oxide powder and tin oxide powder; and developability improvers such as reverse-polarity organic particles and reverse-polarity inorganic particles.

To produce the toner according to the present invention, for example, the binder resin, the wax, the pigment or dye as a colorant, the magnetic material, and optionally the charge control agent and other additives are thoroughly mixed using a mixing machine such as a Henschel mixer or a ball mill, and then the mixture is melt-kneaded using a heat kneading machine such as a heating roll, a kneader or an extruder to make the resins melt one another, in which the metal compound, the pigment, the dye or the magnetic material is dispersed or dissolved, followed by cooling for solidification and thereafter pulverization and optionally classification and surface processing to obtain toner particles, and the inorganic fine powder is optionally added and mixed. Such a production process may preferably be used.

In order to achieve the specific circularity distribution of the toner of the present invention, the toner having at least one endothermic peak in the temperature region of 120° C. or below in differential thermal analysis may only be pulverized (and optionally classified) by a method employing a commonly available pulverizer such as a mechanical impact type pulverizer or a jet type pulverizer, and may preferably be further processed by supplementarily applying a mechanical impact in view of the advantages that a sharper circularity distribution can be attained and the transfer conditions can be set in a broad latitude.

A hot-water bath method in which toner particles having been finely ground (and optionally classified) are dispersed in hot water or a method in which they are passed through a hot stream may be used, but these may result in a low charge quantity of the toner, and, also in view of transfer performance and other image characteristics as well as productivity, a method of processing by applying a mechanical impact is most preferred.

The processing by applying a mechanical impact may include, e.g., a method employing a mechanical impact type pulverizer such as a cryptron system manufactured by Kawasaki Heavy Industries, Ltd and a turbo mill manufactured by Turbo Kogyo K.K.; and a method in which toner particles are pressed against the inside of a casing by centrifugal force by means of high-speed rotating blades to apply a mechanical impact to the toner particles by the action of compressive force and frictional force, as in an appratus of a mechanofusion system manufactured by Hosokawa Mikuron K.K. or a hybridization system manufactured by Nara Kikai Seisakusho.

A processing system employing an impact type surface-processing apparatus for controlling the circularity of toner in the present invention will be described with reference to FIGS. 8 and 9.

Reference numeral 51 denotes a main body casing; 58, a stator; 77, a stator jacket; 63, a recycle pipe; 59, a discharge valve; 19, a discharge chute; and 64, a material feed hopper.

Figure 8:
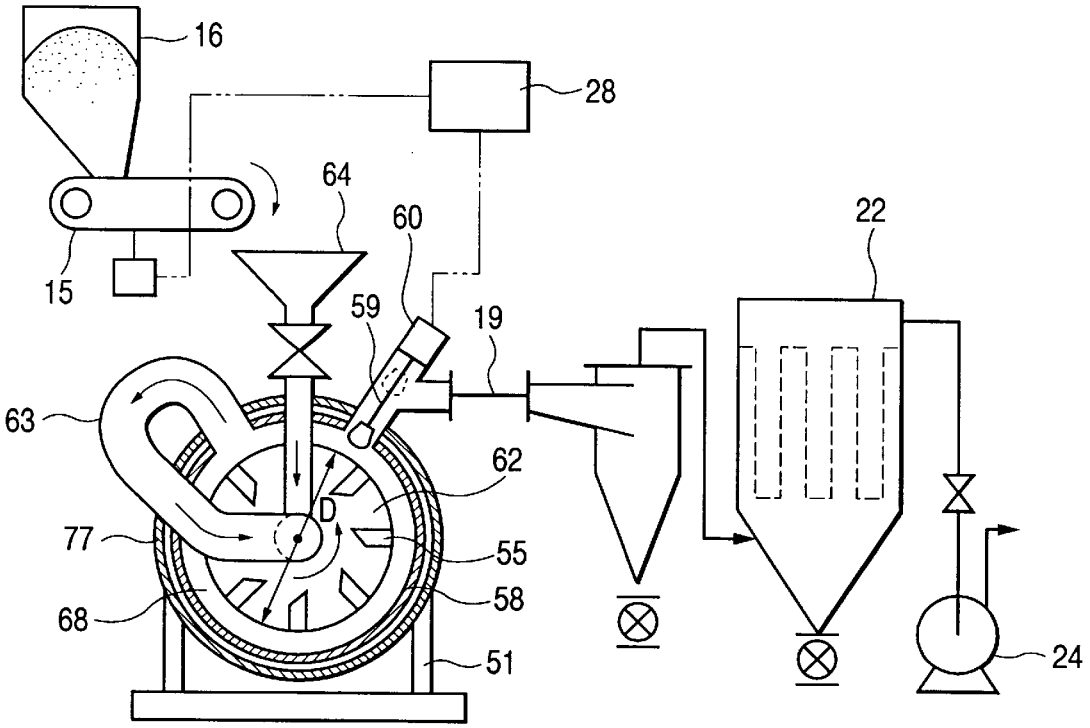
FIG. 8 is an illustration showing an example of a processing system for controlling the circularity of toner particles.
Figure 9:
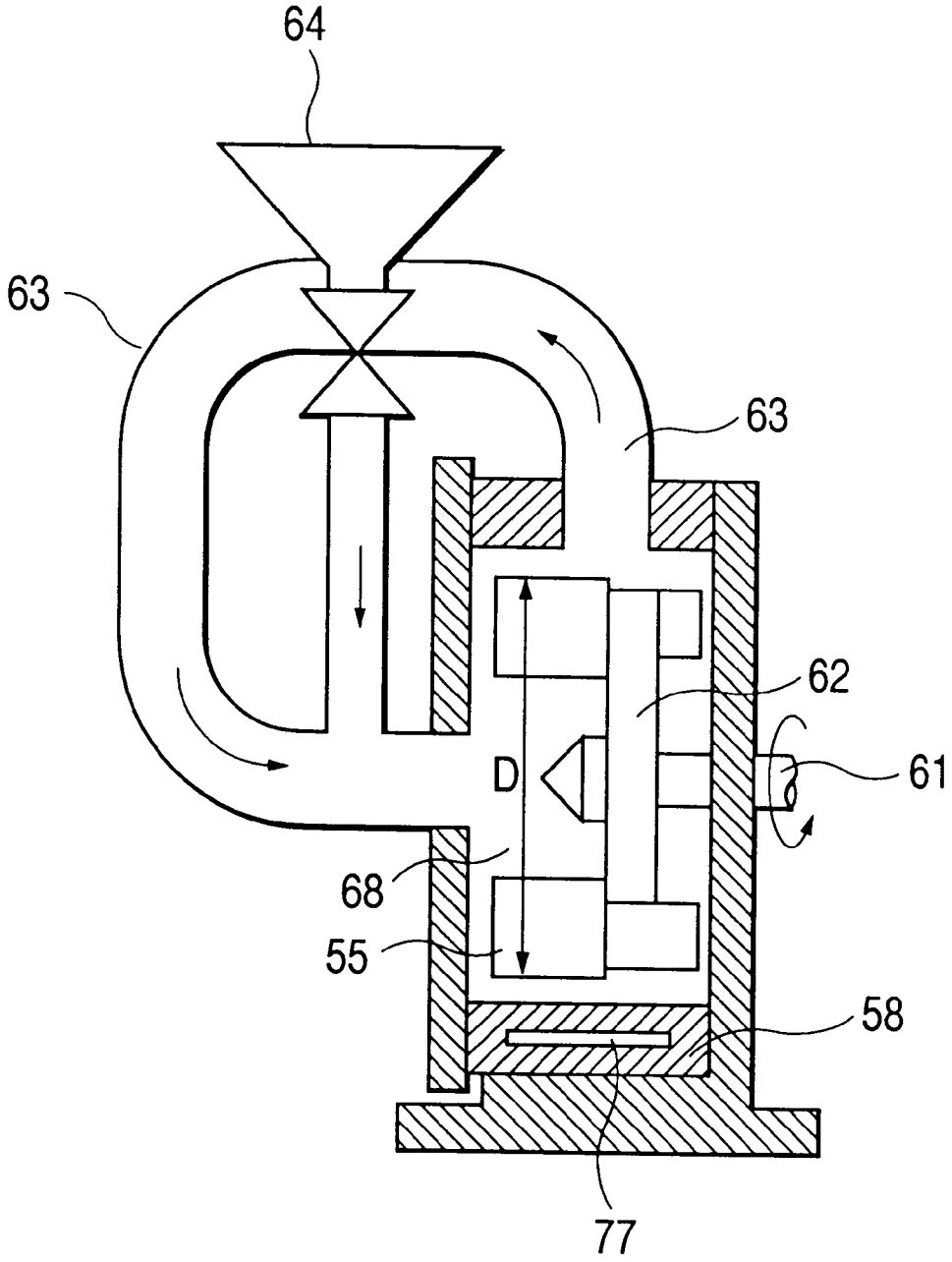
FIG. 9 is an illustration showing an impact type surface processing apparatus used in the system shown in FIG. 8.

In the impact type surface-processing apparatus, as shown in FIGS. 8 and 9, a rotating shaft 61 is driven by a driving means to rotate a rotor 62 at such a peripheral speed that particles do not disintegrate because of the properties of materials to be surface-processed, where abrupt air streams generated concurrently with the rotation of the rotor 62 cause a circulating flow that passes through the recycle pipe 63, opening into an impact chamber 68, and returns to the center of the rotor 62.

In this apparatus, object powder (powder to be processed) fed from the material feed hopper 64 undergoes instantaneous strike action in the impact chamber 68 chiefly by a plurality of rotor blades 55 provided in the rotor 62 rotating at a high speed, and further collide against the stator 58 surrounding the rotor to undergo impact action, so that the particles to be processed are rounded or made spherical. This state progresses with the flying and collision of particles. More specifically, with the flow of air streams generated by the rotation of the rotor blades 55, the particles are passed through the recycle pipe 63 in a plurality of times and thereby processed. The particles further repeatedly undergo strike action on the rotor blades 55 and the stator 58, whereby the particles of the object powder are continuingly made spherical.

The object powder on which the processing to make particles spherical has been completed is, after the discharge valve 59 is opened by a discharge valve control system 28, passed through the discharge chute 19 and is collected in a bag filter 22 communicating with a suction blower 24.

The rotor may preferably be rotated so that the rotor blades 55 have a peripheral speed in the range of from 60 m/second to 150 m/second.

This surface-processing apparatus can be cooled by passing cooling water through the jacket 77, thus the processing temperature can be controlled to a certain degree.

The processing by applying a mechanical impact is particularly preferable when it is carried out after the toner particles are passed through the step of pulverization or after they are further passed through the step of classification, because the "re-transfer" can be prevented more effectively.

As the order of the classification and the surface processing, either may be carried out first. Preferably, the surface processing may be carried out after the classification is carried out because in-machine melt-adhesion of fine toner particles can be prevented. In the step of classification, a multi-division classifier may preferably be used in view of production efficiency.

In the mechanical impact method, a thermomechanical impact may be applied while setting the processing temperature at a temperature around the glass transition point Tg of the toner particles, e.g. (Tg±10° C.). This is preferred in view of the prevention of agglomeration and the productivity. More preferably, the processing may be carried out at a temperature within the glass transition point Tg±5° C. This is especially effective for improvements in developing performance and transfer efficiency.

The toner may have a weight-average particle diameter of 10.0 μm or smaller, preferably in the range of from 3.0 to 8.0 μm. The "re-transfer" can be prevented more effectively when the toner has a weight-average particle diameter of 10.0 μm or smaller. This is presumably because a toner on the electrostatic latent image bearing member before transfer or the intermediate transfer member has a higher charge quantity when the toner has a weight-average particle diameter of 10.0 μm or smaller.

If the toner has a too small weight-average particle diameter, the image density may decrease because of contamination or the like of the toner carrying member.

The weight-average particle diameter of the toner of the present invention is measured using Coulter Counter Model TA-II or Coulter Multisizer (manufactured by Coulter Electronics, Inc.). As an electrolytic solution, an aqueous 1% NaCl solution is prepared using first-grade sodium chloride. For example, ISOTON R-II (available from Coulter Scientific Japan Co.) may be used. Measurement is carried out by adding as a dispersant from 0.1 to 5 ml of a surface active agent (preferably an alkylbenzene sulfonate) to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with diameters of not smaller than 2 μm by means of the above measuring device, using an aperture of 100 μm as its aperture. Then the value according to the present invention is determined which is the volume-based, weight average particle diameter (D4) determined from volume distribution.

The present invention is effective when the surface of the electrostatic latent image bearing member is mainly formed of a polymeric binder; for example, when a protective film mainly formed of a resin is provided on an inorganic electrostatic latent image bearing member comprised of a material such as selenium or amorphous silicon; when a function-separated organic electrostatic latent image bearing member has as a charge transport layer a surface layer formed of a charge-transporting material and a resin; and when the protective layer as described above is further provided thereon. As a means for imparting releasability to such a surface layer, it is possible (1) to use a material with a low surface energy in the resin itself constituting the layer, (2) to add an additive capable of imparting water repellency and lipophilicity, and (3) to disperse in a powdery form a material having a high releasability. As an example of means (1), the object is achieved by introducing into the resin structure a fluorine-containing group or a silicone-containing group. As means (2), a surface active agent may be used as the additive. As means (3), the material may include powders of fluorine-containing compounds such as polytetrafluoroethylene, polyvinylidene fluoride and carbon fluoride. Of these, polytetrafluoroethylene is particularly preferred. In the present invention, the means (3) is particularly preferred, i.e., to disperse the powder with releasability, such as fluorine-containing resin, in the outermost surface layer.

Using any of these means, the surface of the electrostatic latent image bearing member can be made to have a contact angle to water of not smaller than 85 degrees, preferably not smaller than 90 degrees. If its contact angle to water is not smaller than 85 degrees, the toner and the toner carrying member tends to deteriorate as a result of running.

In order to incorporate such powder into the surface, a layer comprising a binder resin with the powder dispersed therein may be provided on the outermost surface of the electrostatic latent image bearing member. Alternatively, in the case of an organic electrostatic latent image bearing member originally mainly comprised of a resin, the powder may be merely dispersed in the outermost layer without anew providing the surface layer.

The powder may preferably be added to the surface layer in an amount of from 1 to 60% by weight, and more preferably from 2 to 50% by weight, based on the total weight of the surface layer. Its addition in an amount less than 1% by weight can be less effective for intended improvement of running performance of the toner and toner carrying member. Its addition in an amount more than 60% by weight is not preferable since the film strength may lower or the amount of light incident on the electrostatic latent image bearing member may decrease.

The present invention is effective especially in the case of a direct charging method where charging means is a charging member brought into contact with the electrostatic latent image bearing member. Since the load on the surface of the electrostatic latent image bearing member is great in such direct charging, compared with the corona charging where charging means is not in contact with the electrostatic latent image bearing member, such an electrostatic latent image bearing member can be remarkably effective for improving its lifetime, and is one of preferred embodiments of application.

A preferred embodiment of the electrostatic latent image bearing member used in the present invention will be described below.

It basically comprises a conductive substrate and a photosensitive layer functionally separated into a charge generation layer and a charge transport layer.

As the conductive substrate, a cylindrical member or a film is used which may be formed of a material including metals such as aluminum and stainless steel; plastics having a coat layer of an alloy such as an aluminum alloy or an indium oxide-tin oxide alloy; papers or plastics impregnated with conductive particles; and plastics having a conductive polymer.

On the conductive substrate, a subbing layer may be provided for the purposes of improving adhesion of the photosensitive layer, improving coating properties, protecting the substrate, covering defects on the substrate, improving the performance of charge injection from the substrate and protecting the photosensitive layer from electrical breakdown. The subbing layer may be formed of a material such as polyvinyl alcohol, poly-N-vinyl imidazole, polyethylene oxide, ethyl cellulose, methyl cellulose, nitrocellulose, an ethylene-acrylic acid copolymer, polyvinyl butyral, phenol resin, casein, polyamide, copolymer nylon, glue, gelatin, polyurethane or aluminum oxide. The subbing layer may usually be in a thickness of from 0.1 to 10 $\mu$m, and preferably from 0.1 to 3 $\mu$m.

The charge generation layer is formed by coating a solution prepared by dispersing a charge-generating material in a suitable binder, or by vacuum deposition of the charge-generating material. The charge-generating material may include organic materials such as azo pigments, phthalocyanine pigments, indigo pigments, perylene pigments, polycyclic quinone pigments, squarilium dyes, pyrylium salts, thiopyrylium salts, triphenylmethane dyes, and inorganic materials such as selenium and amorphous silicon. The binder can be selected from a vast range of binder resins, including, e.g., resins such as polycarbonate resin, polyester resin, polyvinyl butyral resin, polystyrene resin, acrylic resin, methacrylic resin, phenol resin, silicone resin, epoxy resin and vinyl acetate resin. The binder contained in the charge generation layer may be in an amount not more than 80% by weight, and preferably from 0 to 40% by weight, based on the weight of the charge-generating material. The charge generation layer may preferably have a thickness of 5 $\mu$m or smaller, and particularly from 0.05 to 2 $\mu$m.

The charge transport layer has the function to receive charge carriers from the charge generation layer and transport them. The charge transport layer is formed by coating a solution prepared by dispersing a charge-transporting material in a solvent optionally together with a binder resin. Usually, it may preferably have a layer thickness of from 5 to 40 $\mu$m. The charge-transporting material may include polycyclic aromatic compounds having in the main chain or side chain a structure such as biphenylene, anthracene, pyrene or phenanthrene; nitrogen-containing cyclic compounds such as indole, carbazole, oxadiazole and pyrazoline; hydrozone compounds; styryl compounds; and inorganic compounds such as selenium, selenium-tellurium, amorphous silicone and cadmium sulfide.

The binder resin in which the charge-transporting material is dispersed may include thermoplastic resins such as polycarbonate resin, polyester resin, polymethacrylate, polystyrene resin, acrylic resin and polyamide resin; and organic photoconductive polymers such as poly-N-vinyl carbazole and polyvinyl anthracene.

A protective layer may be provided as the surface layer. Resins for the protective layer include resins such as polyester, polycarbonate, acrylic resin, epoxy resin and phenol resin, or a product obtained by curing any of these resins with a curing agent, any of which may be used alone or in combination.

In the resin of the protective layer, conductive fine particles may be dispersed. As examples of the conductive fine particles, they may include fine particles of a metal or metal oxide. Preferably, they may include ultrafine particles of zinc oxide, titanium oxide, tin oxide, antimony oxide, indium oxide, bismuth oxide, tin oxide-coated titanium oxide, tin-coated titanium oxide, antimony-coated tin oxide or zirconium oxide. Any of these may be used alone or may be used in the form of a mixture of two or more.

In general, when particles are dispersed in the protective layer, the particles may preferably have a particle diameter smaller than the wavelength of incident light in order to prevent the particles from causing scattering of incident light. The conductive, insulating fine particles dispersed in the protective layer in the present invention may preferably have particle diameters of 0.5 $\mu$m or smaller.

Such particles in the protective layer may preferably be in a content of from 2 to 90% by weight, and more preferably from 5 to 80% by weight, based on the total weight of the protective layer.

The protective layer may preferably have a layer thickness of from 0.1 to 10 $\mu$m, and more preferably from 1 to 7 $\mu$m.

The surface layer can be formed by coating a resin dispersion by spray coating, beam coating or dip coating.

A contact transfer process that can be applied to the image forming method of the present invention will be specifically described below.

In the contact transfer process, the developed image is electrostatically transferred to the transfer medium while pressing a transfer means against the electrostatic latent image bearing member or intermediate transfer member, interposing the transfer medium between them. The transfer means may preferably be brought into pressure contact at a linear pressure of 2.9 N/m (3 g/cm) or higher, and more preferably 19.6 N/m (20 g/cm) or higher. If the linear pressure as contact pressure is lower than 2.9 N/m (3 g/cm), transport aberration of transfer mediums and faulty transfer tend to occur unpreferably.

As the transfer means used in the contact transfer process, an assembly having a transfer roller or a transfer belt is used. The transfer roller is comprised of at least a mandrel and a conductive elastic layer. The conductive elastic layer may preferably be made of an elastic material with a volume resistivity of about $10^6$ to $10^{10}$ $\Omega$·cm, such as urethane resin and EPDM having a conductive material such as carbon dispersed therein.

The present invention is especially effectively used in an image forming apparatus comprising an electrostatic latent image bearing member (photosensitive member) whose surface layer is formed of an organic compound. This is because, when the organic compound forms the surface layer of the photosensitive member, the binder resin contained in the toner particles more tends to adhere to the surface layer than other photosensitive members making use of an inorganic material, tending to cause a more lowering of transfer performance.

The surface material of the photosensitive member according to the present invention may include, e.g., silicone resins, vinylidene chloride, an ethylene-vinylidene chloride copolymer, a styrene-acrylonitrile copolymer, a styrene-methyl methacrylate copolymer, styrene resins, polyethylene terephthalate, and polycarbonate. Without limitation to these, it is also possible to use copolymers with other monomers or the binder resins previously described, and resin blends.

The present invention can be effectively applied especially to image forming apparatus having a small-diameter photosensitive member of 50 mm or smaller in diameter. This is because, in the case of the small-diameter photosensitive member, the curvature with respect to a like linear pressure is so great that the pressure tends to concentrate at the contact portion. The like phenomenon is considered to be seen also in belt type photosensitive members. The present invention is effective also for image forming apparatus whose belt type photosensitive member forms a curvature radius of 25 mm or smaller at the transfer portion.

In the present invention, in view of environmental protection, a charging member may preferably be brought into contact with the photosensitive member so that no ozone may be generated.

When the charging roller is used, preferable process conditions are as follows: Contact pressure of the charging roller is 5 to 500 g/cm; and when a voltage formed by superimposing an AC voltage on a DC voltage is used, AC voltage is 0.5 to 5 kVpp, AC frequency is 50 to 5 kHz, and DC voltage is ±0.2 to ±5 kV.

As other charging means, a method making use of a charging blade and a method making use of a conductive brush are available. These contact charging means have the advantages that no high voltage is required and ozone less generates.

In the present invention, as a means for forming a thin layer of toner on the toner carrying member in the developing step, a member that controls the layer thickness of toner may be provided in touch with the surface of the toner carrying member by an elastic force. This makes the toner participating in development have a higher charge quantity, and is preferable especially in view of transfer performance. The toner layer thickness control member brought into touch by elastic force may be comprised of, e.g., a member utilizing rubber elasticity or elasticity of a metallic leaf spring.

The charging roller or the charging blade, serving as the contact charging means, may preferably be made of conductive rubber, and a release coating may be provided on its surface. To form the release coating, it is possible to use nylon resins, PVDF (polyvinylidene fluoride), PVDC (polyvinylidene chloride), or fluorine acrylic resins.

The image forming method of the present invention will be specifically described below with reference to the accompanying drawings.

FIG. 1 illustrates an image forming apparatus of the type wherein toner images on the electrostatic latent image bearing member are directly transferred to the transfer medium.

In FIG. 1, reference numeral 100 denotes a photosensitive drum serving as the electrostatic latent image bearing member, around which a primary charging roller 117, a developing assembly 140, a transfer charging roller 114, a cleaner (a cleaning means) 116 and a resistor roller 124 are provided. Then the photosensitive drum 100 is charged to −700 V by the operation of the primary charging roller 117 (applied voltage: AC voltage of −2.0 kVpp and DC voltage of −700 Vdc). The photosensitive drum 100 is irradiated with laser light 123 through a laser light generator 121 to carry out exposure to form an electrostatic latent image. The electrostatic latent image on the photosensitive drum 100 is developed by the one-component magnetic toner supplied from the developing assembly 140, and the toner image thus formed is transferred to a transfer medium by the operation of the transfer charging roller 114, brought into contact with the photosensitive drum interposing the transfer medium between them. The transfer medium holding the toner image is transported to a fixing assembly 126 by a transport belt 125, and is fixed onto the transfer medium. The toner partly remaining on the electrostatic latent image bearing member is removed by cleaning using the cleaning means 116.

Figure 2:
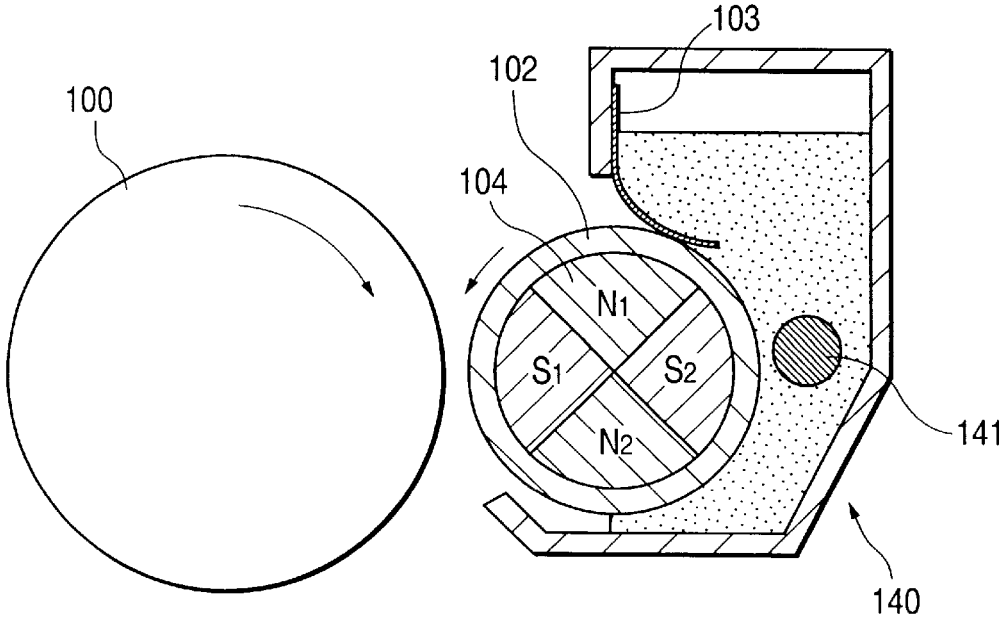
FIG. 2 is a schematic illustration showing an example of a developing assembly for one-component development.
Figure 3:
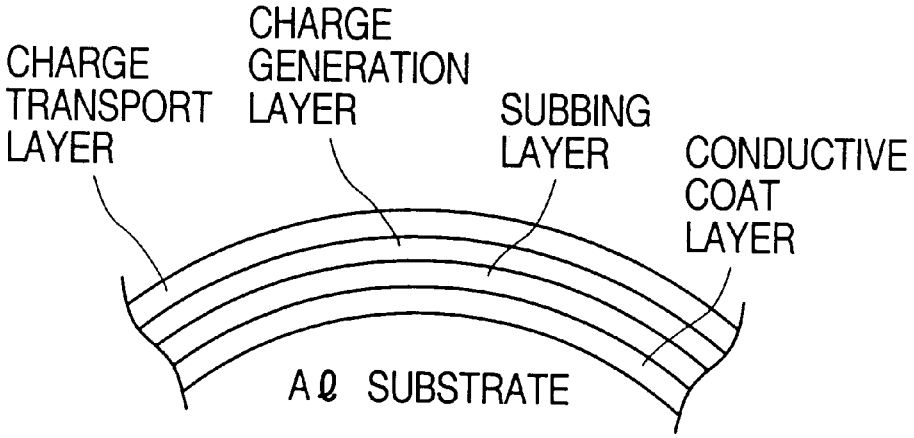
FIG. 3 is a schematic illustration showing an example of the layer configuration of a photosensitive member used in the present invention.

As shown in FIG. 2, the developing assembly 140 is provided, in proximity to the photosensitive drum 100, with a cylindrical toner carrying member 102 (hereinafter "developing sleeve") made of a non-magnetic metal such as aluminum or stainless steel, and the gap between the photosensitive drum 100 and the developing sleeve 102 is set at, for example, about 300 μm by the aid of a sleeve-to-drum distance holding member (not shown). In the developing assembly 140, an agitating rod 141 is provided. The developing sleeve 102 is internally provided with a magnet roller 104, which is secured concentrically with the developing sleeve 102. The developing sleeve 102 is set rotatable. The magnet roller 104 has a plurality of magnetic poles as shown in the drawing. Magnetic pole S1 affects development; N1, control of toner coat quantity (toner layer thickness); S2, intake and transport of the toner; and N2, prevention of the magnetic toner from spouting. As a member to control the quantity of the magnetic toner transported while adhering to the developing sleeve 102, an elastic blade 103 is provided so that the quantity (layer thickness) of the toner transported to the development zone is controlled according to the pressure under which the elastic blade 103 is brought into touch with the developing sleeve 102. In the developing zone, DC and AC development bias is applied across the photosensitive drum 100 and the developing sleeve 102, and the toner on the developing sleeve 102 fly onto the photosensitive drum 100 in conformity with the electrostatic latent image to form a visible image.

Figure 7:
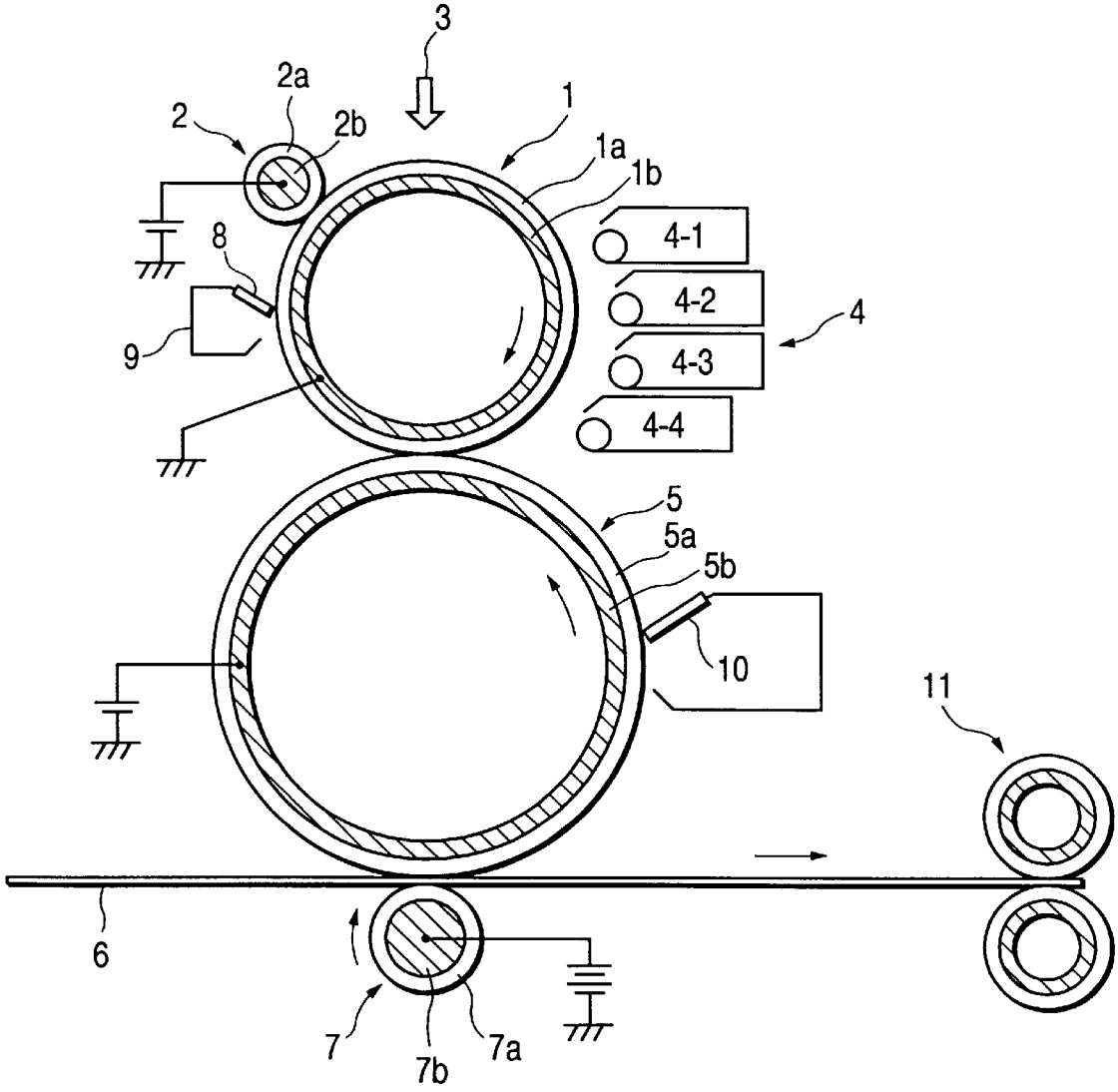
FIG. 7 is a schematic illustration showing another example of an image forming apparatus preferred in the present invention.

FIG. 7 illustrates an image forming apparatus of the type wherein toner images on the electrostatic latent image bearing member are primarily transferred to an intermediate transfer member and thereafter the toner images on the intermediate transfer member are secondarily transferred to the recording medium.

A photosensitive member 1 comprises a substrate 1*a* and provided thereon a photosensitive layer 1*b* having an organic photo-semiconductor, and is rotated in the direction of an arrow. By means of a charging roller 2 (a conductive elastic layer 2*a* and a mandrel 2*b*), the surface of the photosensitive member 1 is electrostatically charged to have a surface potential of about −600 V. Exposure is carried out using a polygon mirror by on-off control on the photosensitive member 1 in accordance with digital image information, whereby an electrostatic latent image with an exposed-area potential of −100 V and a dark-area potential of −600 V. Using a plurality of developing assemblies 4–1, 4–2, 4–3 and 4–4, the magenta toner, cyan toner, yellow toner or black toner is imparted to the surface of the photosensitive member 1 to form toner images by reverse development. The toner images are transferred to an intermediate transfer member 5 (an elastic layer 5*a*, a mandrel 5*b* as a support) for each color to form four color, color-superimposed developed images on the intermediaté transfer member 5. The toner remaining on the photosensitive member 1 after transfer is collected in a residual toner container 9 by means of a cleaning member 8.

Since the toner according to the present invention has a high transfer efficiency, problems may hardly occur even in a system having a simple bias roller or having no cleaning member.

The intermediate transfer member 5 is comprised of the pipe-like mandrel 5*b* and the elastic layer 5*a* provided thereon by coating, formed of nitrile-butadiene rubber (NBR) in which carbon black as the conductivity-providing agent has been well dispersed. The coat layer thus formed has a hardness according to JIS K-6301, of 30 degrees and a volume resistivity of $10^9$ Ω·cm. Transfer electric current necessary for the transfer from the photosensitive member 1 to the intermediate transfer member 5 is about 5 μA, which can be obtained by applying a voltage of +2,000 V to the mandrel 5*a* from a power source. After the toner images have been transferred from the intermediate transfer member 5 to the transfer medium 6, the surface of the intermediate transfer member may be cleaned by means of a cleaning member 10.

The transfer roller 7 is formed by coating on a mandrel 7*b* of 20 mm diameter a foamable material of an ethylene-propylene-diene terpolymer (EPDM) in which carbon black conductivity-providing agent has been well dispersed. A transfer roller whose elastic layer 7*a* thus formed shows a volume resistivity of $10^6$ Ω·cm and a hardness according to JIS K-6301, of 35 degrees is used. A voltage is applied to the transfer roller to flow a transfer current of 15 μA. With regard to the toner remaining as a contaminant on the transfer roller 7 when the toner images are one-time transferred from the intermediate transfer member 5 to the transfer medium 6, it is common to use a fur brush cleaner as a cleaning member or to use a cleanerless system.

In the present invention, any one of the developing assemblies 4–1, 4–2, 4–3 and 4–4 is set up by a magnetic one-component jumping development system making use of a magnetic toner, and the developing assembly constructed as shown in FIG. 2 is used. As other three developing assemblies for non-magnetic color toners, developing assemblies for two-component magnetic brush development or developing assemblies for non-magnetic one-component development are used.

According to the present invention, the use of the toner having at least one endothermic peak in the temperature region of 120° C. or below in differential thermal analysis and having, in its particles having particle diameters of 3 μm or larger, not less than 90% by number of particles having a circularity $\dot{a}$ of at least 0.90 and less than 30% by number of particles having a circularity $\dot{a}$ of at least 0.98 makes it possible to obtain high-grade and sharp images without causing "re-transfer" while maintaining a high image density and a high latent image reproducibility.

In particular, a broader transfer latitude than conventional magnetic toners can be attained.

EXAMPLES

The present invention will be described below in greater detail by giving Production Examples and Examples, which, however, by no means limit the present invention. In the following formulation, "part(s)" refers to "part(s) by weight" in all occurrences.

Toner Production Example 1

| | |
|---|---|
| Styrene/butyl acrylate/butyl maleate half ester copolymer (binder resin; main-peak molecular weight: about 40,000; no peak in the region of molecular weight not more than 15,000; proportion of component with molecular weight not more than 10,000: 20%; glass transition point Tg: 60° C.; Mw/Mn: 31) | 100 parts |
| Magnetic material (average particle diameter: 0.22 μm) | 100 parts |
| Iron complex of monoazo dye (negative charge control agent) | 2 parts |
| Low-molecular weight polyethylene (endothermic peak in differential thermal analysis: 106.7° C.) | 4 parts |

The above materials were mixed using a blender, and then melt-kneaded using a twin-screw extruder heated to 130° C. The kneaded product obtained was cooled, and then crushed with a hammer mill. The crushed product was pulverized (finely ground) by means of a jet mill. At this stage, magnetic toner particles were repeatedly pulverized in the step of pulverization as shown in FIG. 5, until they have the stated particle diameters. Subsequently, the pulverized product obtained was strictly classified using a multi-division classifier utilizing the Coanda effect, to obtain classified magnetic toner particles.

The classified magnetic toner particles obtained were surface-processed at 1,600 rpm (peripheral speed: 80 m/sec.) for 3 minutes, using the impact type surface processing apparatus as shown in FIGS. 8 and 9, i.e., a surface modifying apparatus of the type of rotating a rotor to apply a mechanical impact force, to obtain magnetic toner particles. In the surface modifying apparatus, 20° C. cooling water was passed for the purpose of controlling the apparatus inside-temperature within the desired range at the time of surface modification. Here, air-stream temperature inside the processing apparatus before the feeding of the classified magnetic toner particles was 30° C. After the feeding of the classified magnetic toner particles, the air-stream temperature inside the processing apparatus gradually became higher, and, after 3 minutes, the inside air-stream temperature reached 59° C. at maximum.

In the classified magnetic toner particles, fine powder having particle diameters of 4 μm or smaller in the particle size distribution of the classified particles was in a content of 16% by number. After the processing, fine powder having particle diameters of 4 μm or smaller in the magnetic toner particles was in a content of 19% by number.

Subsequently, to 100 parts by weight of the magnetic toner particles thus obtained, 1.2 parts of dry-process silica with a primary particle diameter of 12 nm made hydrophobic by treatment with silicone oil and hexamethyldisilazane (BET specific surface area after treatment: 120 $m^2/g$) was added, followed by mixing by means of a mixing machine to obtain a magnetic toner 1.

The magnetic toner 1 thus obtained had a weight average particle diameter of 6.7 μm, and had, in its particles having particle diameters of 3 μm or larger, 96.7% by number of particles having a circularity $\dot{a}$ of at least 0.90 and 23.2% by number of particles having a circularity $\dot{a}$ of at least 0.98. Its standard deviation SD of circularity distribution in the particles having particle diameters of 3 μm or larger was 0.031.

Physical properties of the magnetic toner 1 thus obtained are shown in Table 1.

Toner Production Examples 2 to 4

Magnetic toners 2, 3 and 4 were obtained in the same manner as in Toner Production Example 1 except that conditions of the surface modifying apparatus used therein were changed.

Physical properties of the magnetic toners 2, 3 and 4 thus obtained are shown in Table 1.

The content of fine powder (% by number of the particles of 4 μm or smaller) in each of the magnetic toners 2, 3 and 4 was 21%, 18.5% and 18%, respectively.

Toner Production Example 5

| | |
|---|---|
| Styrene/butyl acrylate/butyl maleate half ester copolymer (binder resin; main-peak molecular weight: about 41,000; no peak in the region of molecular weight not more than 15,000; proportion of component with molecular weight not more than 10,000: 22%; glass transition point Tg: 62° C.; Mw/Mn: 27) | 100 parts |
| Magnetic material (average particle diameter: 0.22 μm) | 100 parts |
| Iron complex of monoazo dye (negative charge control agent) | 3 parts |
| Low-molecular weight polyethylene (endothermic peak in differential thermal analysis: 104.4° C.) | 3 parts |

A magnetic toner 5 was obtained in the same manner as in Toner Production Example 1 except that the above materials were used. The magnetic toner thus obtained had a weight average particle diameter of 6.7 μm, and had, in its particles having particle diameters of 3 μm or larger, 93.8% by number of particles having a circularity a of at least 0.90 and 22.2% by number of particles having a circularity a of at least 0.98. Its standard deviation SD of circularity distribution in the particles having particle diameters of 3 μm or larger was 0.036. The inside air-stream temperature at the time of processing was 60° C. at maximum on account of the heat generated by the impact of particles against the rotor.

Physical properties of the magnetic toner 5 thus obtained are shown in Table 1.

Toner Production Example 6

A magnetic toner 6 was obtained in the same manner as in Toner Production Example 1 except that the conditions of the surface modifying apparatus used therein were changed so as to be driven at 1,200 rpm (peripheral speed: 60 m/sec.) for 1 minute.

Physical properties of the magnetic toner 6 thus obtained are shown in Table 1.

Toner Production Example 7

| | |
|---|---|
| Styrene/butyl acrylate/butyl maleate half ester copolymer (binder resin; main-peak molecular weight: about 30,000; no peak in the region of molecular weight not more than 15,000; proportion of component with molecular weight not more than 10,000: 25%; glass transition point Tg: 62° C.; Mw/Mn: 33) | 100 parts |
| Magnetic material (average particle diameter: 0.22 μm) | 100 parts |
| Iron complex of monoazo dye (negative charge control agent) | 2 parts |
| Low-molecular weight polyethylene (endothermic peak in differential thermal analysis: 116° C.) | 3 parts |

A magnetic toner 7 was obtained in the same manner as in Toner Production Example 1 except that the above materials were used and the conditions of the surface modifying apparatus were changed so as to be driven at 1,200 rpm (peripheral speed: 60 m/sec.) for 1 minute.

Physical properties of the magnetic toner 7 thus obtained are shown in Table 1.

Toner Production Example 8

| | |
|---|---|
| Polyester resin (binder resin; main-peak molecular weight: about 7,000; proportion of component with molecular weight not more than 10,000: 40%; glass transition point Tg: 63° C.; Mw/Mn: 35) | 100 parts |
| Magnetic material (average particle diameter: 0.22 μm) | 60 parts |
| Iron complex of monoazo dye (negative charge control agent) | 2 parts |
| Low-molecular weight polyethylene (endothermic peak in differential thermal analysis: 140° C.) | 3 parts |

The above materials were mixed using a blender, and then melt-kneaded using a twin-screw extruder heated to 130° C. The kneaded product obtained was cooled, and then crushed with a hammer mill. The crushed product was pulverized (finely ground) by means of a jet mill. The pulverized product obtained was strictly classified using a multi-division classifier utilizing the Coanda effect, to obtain classified magnetic toner particles.

Subsequently, to 100 parts by weight of the classified magnetic toner particles thus obtained, 0.8 part of dry-process silica with a primary particle diameter of 16 nm made hydrophobic by treatment with hexamethyldisilazane (BET specific surface area after treatment: 100 $m^2/g$) was added, followed by mixing by means of a mixing machine to obtain magnetic toner 8.

Physical properties of the magnetic toner 8 thus obtained are shown in Table 1.

Toner Production Example 9

Using the classified toner particles obtained in Toner Production Example 8, a magnetic toner 9 was obtained in the same manner as in Toner Production Example 8 except that the particles were processed by instantaneously passing them through 300° C. hot air.

Physical properties of the magnetic toner 9 thus obtained are shown in Table 1.

Toner Production Example 10

Using the classified toner particles obtained in Toner Production Example 8, a magnetic toner 10 was obtained in the same manner as in Toner Production Example 1 except that the conditions of the surface modifying apparatus were changed so as to be driven at 1,200 rpm (peripheral speed: 60 m/sec.) for 1 minute.

Physical properties of the magnetic toner 10 thus obtained are shown in Table 1.

Toner Production Example 11

| | |
|---|---|
| Styrene/butyl acrylate/butyl maleate half ester copolymer (binder resin; main-peak molecular weight: about 41,000; no peak in the region of molecular weight not more than 15,000; proportion of component with molecular weight not more than 10,000: 22%; glass transition point Tg: 62° C.; Mw/Mn: 27) | 100 parts |
| Magnetic material (average particle diameter: 0.22 μm) | 100 parts |
| Iron complex of monoazo dye (negative charge control agent) | 3 parts |
| Low-molecular weight polypropyleme (endothermic peak in differential thermal analysis: 140° C.) | 3 parts |

A magnetic toner 11 was obtained in the same manner as in Toner Production Example 1 except that the above materials were used. The magnetic toner thus obtained had a weight average particle diameter of 6.9 μm, and had, in its particles having particle diameters of 3 μm or larger, 96.3% by number of particles having a circularity $\dot{a}$ of at least 0.90 and 32.0% by number of particles having a circularity $\dot{a}$ of at least 0.98. Its standard deviation SD of circularity distribution in the particles having particle diameters of 3 μm or larger was 0.036. The inside air-stream temperature at the time of processing was 73° C. at maximum on account of the heat generated by the impact of particles against the toner.

Physical properties of the magnetic toner 11 thus obtained are shown in Table 1.

The processing apparatus cooling water used at the time of processing was set at a temperature of 30° C.

Toner Production Example 12

| | |
|---|---|
| Styrene/butyl acrylate/butyl maleate half ester copolymer (binder resin; main-peak molecular weight: about 20,000; no peak in the region of molecular weight not more than 15,000; proportion of component with molecular weight not more than 10,000: 42%; glass transition point Tg: 62° C.; Mw/Mn: 22) | 100 parts |
| Magnetic material (average particle diameter: 0.22 μm) | 100 parts |
| Iron complex of monoazo dye (negative charge control agent) | 3 parts |
| Low-molecular weight polyethylene (endothermic peak in differential thermal analysis: 104.4° C.) | 3 parts |

A magnetic toner 12 was obtained in the same manner as in Toner Production Example 1 except that the above materials were used. The magnetic toner thus obtained had a weight average particle diameter of 6.5 μm, and had, in its particles having particle diameters of 3 μm or larger, 90.2% by number of particles having a circularity $\dot{a}$ of at least 0.90 and 8.5% by number of particles having a circularity $\dot{a}$ of at least 0.98. Its standard deviation SD of circularity distribution in the particles having particle diameters of 3 μm or larger was 0.047. The inside air-stream temperature at the time of processing was 45° C. at maximum on account of the heat generated by the impact of particles against the toner.

Physical properties of the magnetic toner 12 thus obtained are shown in Table 1.

In the magnetic toner 12, after the classification, fine powder having particle diameters of 4 μm or smaller in the particle size distribution of the classified magnetic toner particles was in a content of 15% by number. After the processing, fine powder having particle diameters of 4 μm or smaller in the magnetic toner particles was in a content of 26% by number.

Toner Production Example 13

| | |
|---|---|
| Styrene/butyl acrylate/butyl maleate half ester copolymer (binder resin; main-peak molecular weight: about 8,000; subpeak molecular weight: about 650,000; proportion of component with molecular weight not more than 10,000: 52%; glass transition point Tg: 62° C.; Mw/Mn: 38) | 100 parts |
| Magnetic material (average particle diameter: 0.22 μm) | 100 parts |
| Iron complex of monoazo dye (negative charge control agent) | 3 parts |
| Low-molecular weight polyethylene (endothermic peak in differential thermal analysis: 104.4° C.) | 3 parts |

A magnetic toner 13 was obtained in the same manner as in Toner Production Example 1 except that the above materials were used. The magnetic toner thus obtained had a weight average particle diameter of 6.4 μm, and had, in its particles having particle diameters of 3 μm or larger, 87.0% by number of particles having a circularity $\dot{a}$ of at least 0.90 and 4.5% by number of particles having a circularity $\dot{a}$ of at least 0.98. Its standard deviation SD of circularity distribution in the particles having particle diameters of 3 μm or larger was 0.046. The inside air-stream temperature at the time of processing was 37° C. at maximum on account of the heat generated by the impact of particles against the toner.

Physical properties of the magnetic toner 13 thus obtained are shown in Table 1.

In the magnetic toner 13, after the classification, fine powder having particle diameters of 4 μm or smaller in the particle size distribution of the classified magnetic toner particles was in a content of 14% by number. After the processing, fine powder having particle diameters of 4 μm or smaller in the magnetic toner particles was in a content of 27% by number.

TABLE 1

| | Particles with circularity | | DSC | | Toner weight | Surface modifiying conditions | | |
|---|---|---|---|---|---|---|---|---|
| | a ≧ 0.90 (% by number) | a ≧ 0.98 (% by number) | endo-thermic peak (° C.) | Circularity distribition standard deviation | average particle diameter (μm) | Peripheral speed (m/s) | Modi-fying time (min) | In-machine maximum temperature (° C.) |
| Toner 1 | 96.7 | 23.2 | 106.7 | 0.031 | 6.7 | 80 | 3 | 59 |
| Toner 2 | 96.9 | 24.1 | 106.7 | 0.030 | 6.5 | 90 | 2 | 65 |
| Toner 3 | 94.7 | 22.7 | 106.7 | 0.033 | 6.7 | 80 | 1.5 | 56 |
| Toner 4 | 96.1 | 22.0 | 106.7 | 0.032 | 6.7 | 70 | 3 | 52 |
| Toner 5 | 93.8 | 22.2 | 104.4 | 0.036 | 6.7 | 80 | 2 | 60 |
| Toner 6 | 92.3 | 21.8 | 104.4 | 0.043 | 7.1 | 60 | 1 | 42 |
| Toner 7 | 91.2 | 20.8 | 116.0 | 0.045 | 8.5 | 60 | 1 | 41 |
| Toner 8 | 87.2 | 11.4 | 140.0 | 0.051 | 10.8 | Unprocessed | | |
| Toner 9 | 97.9 | 48.6 | 140.0 | 0.033 | 12.0 | 300° C. hot-air processed | | |
| Toner 10 | 89.1 | 23.5 | 140.0 | 0.047 | 10.6 | 60 | 1 | 40 |
| Toner 11 | 96.3 | 32.0 | 140.0 | 0.036 | 6.9 | 90 | 4 | 73 |
| Toner 12 | 90.2 | 8.5 | 104.4 | 0.047 | 6.5 | 80 | 2 | 45 |
| Toner 13 | 87.0 | 4.5 | 104.4 | 0.046 | 6.4 | 60 | 1 | 37 |

Photosensitive Member Production Example 1

To produce a photosensitive member, an aluminum cylinder of 30 mm diameter was used as the substrate. On this substrate, the layers with the configuration as shown in FIG.

3 and the following were successively superposingly formed by dip coating to produce the photosensitive member.

(1) Conductive coat layer: Mainly formed of phenol resin with tin oxide powder and titanium oxide powder dispersed therein. Layer thickness: 15 μm.

(2) Subbing layer: Mainly formed of modified nylon and copolymer nylon. Layer thickness: 0.6 μm.

(3) Charge generation layer: Mainly formed of butyral resin with an azo pigment dispersed therein, the azo pigment having an absorption in the region of long wavelength. Layer thickness: 0.6 μm.

(4) Charge transport layer: Mainly formed of polycarbonate resin (molecular weight as measured by Ostwald viscometry: 20,000) with a hole-transporting triphenylamine compound dissolved therein in a weight ratio of 8:10, followed by further addition of polytetrafluoroethylene powder (average particle diameter: 0.2 μm) in an amount of 10% by weight based on the total weight of solid contents and then uniform dispersion. Layer thickness: 15 μm. Its contact angle to water was 95 degrees.

The contact angle was measured using pure water, and using as a measuring device a contact angle meter Model CA-X, manufactured by Kyowa Kaimen Kagaku K.K.

Photosensitive Member Production Example 2

The procedure of Photosensitive Member Production Example 1 was repeated to produce a photosensitive member, except that the polytetrafluoroethylene powder was not added. The contact angle to water was 74 degrees.

Photosensitive Member Production Example 3

To produce a photosensitive member, the procedure of Photosensitive Member Production Example 1 was repeated up to the formation of the charge generation layer. The charge transport layer was formed using a solution prepared by dissolving the hole-transporting triphenylamine compound in the polycarbonate resin in a weight ratio of 10:10, and in a layer thickness of 20 μm. To further form a protective layer thereon, a composition prepared by dissolving the like materials in a weight ratio of 5:10, followed by addition of polytetrafluoroethylene powder (average particle diameter: 0.2 μm) in an amount of 30% by weight based on the total weight of solid contents and then uniform dispersion, was spray coated on the charge transport layer. Layer thickness: 5 μm. Its contact angle to water was 102 degrees.

Example 1

As the image forming apparatus, the apparatus as schematically shown in FIGS. 1 and 2 was used.

As the electrostatic latent image bearing member, the organic photoconductor (OPC) photosensitive drum produced in Photosensitive Member Production Example 3 was used, and its dark portion potential $V_D$ and light portion potential $V_L$ were set at −650 V and −210 V, respectively. The gap between the photosensitive drum and the toner carrying member (developing sleeve) was set to be 300 μm. As the toner coat control member, a urethane rubber blade of 1.0 mm thick and 10 mm in free length was brought into touch with the surface of the toner carrying member at a linear pressure of 14.7 N/m (15 g/cm).

Subsequently, as development bias, DC bias component Vdc of −500 V and superimposing AC bias component Vp-p of 1,500 V and f=2,000 Hz were used.

Figure 4:
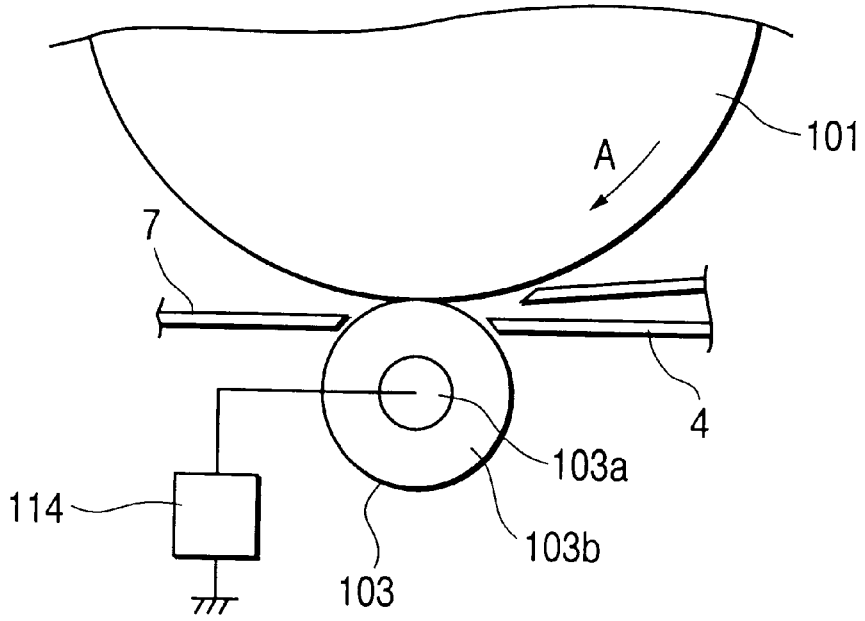
FIG. 4 is a schematic illustration showing an example of a contact transfer means.

A transfer roller as shown in FIG. 4 [made of ethylene-propylene rubber with conductive carbon dispersed therein; volume resistivity of the conductive resilient layer: $10^8$ Ω·cm; surface-rubber hardness: 24 degrees; diameter: 20 mm; contact pressure: 49 N/m (50 g/cm)] was set rotary at a speed equal to the peripheral speed of the photosensitive drum (48 mm/sec), and a transfer bias was set variable between 2 μA to 20 μA to evaluate the latitude of transfer performance (transfer latitude). As a toner, the magnetic toner 1 was used and images were reproduced in an environment of 32.5° C./80% RH. As transfer paper, paper with a basis weight of 75 g/m$^2$ was used.

In this image reproduction, the range of transfer bias within which 90% or more of transfer efficiency was achieved in the transfer from the photosensitive member to the transfer medium was 4 μA to 18 μA, showing a high transfer efficiency under a broad condition, and good images were formed which were free of blank areas caused by poor transfer in characters or lines and also free of black spots around the images.

The above transfer efficiency is an averaged value of three (3) transfer efficiencies which are determined in the following manner. Solid black toner images of 5 mm square were formed on the transfer medium at three spots of the center and both ends. The transfer medium was stopped in its passage in the image forming apparatus before it reached the image fixing means. For each of the three solid black toner images, the toner remaining after the image transfer on the photosensitive member was taken off by taping with a Mylar tape, and the tape was then stuck on a sheet of paper to measure Macbeth density (a) of the tape. Further, A Mylar tape was stuck on the toner image transferred to the transfer paper to measure the Macbeth density (b). Also, Macbeth density (c) of a virgin Mylar tape stuck on a sheet of paper was measured. Macbeth density (c) was subtracted from Macbeth density (a) and Macbeth density (b), respectively, to give numerical values, which were made remaining toner density (A) after the image transfer and transferred image density (B). The densities (A) and (B) were used to determine the transfer efficiency from the following expression.

Remaining toner density (A)=Density (a)−Density (c)

Transferred image density (B)=Density (b)−Density (c)

Transfer efficiency (%)={Transferred image density (B)/(Remaining toner density (A)+Transferred image density (B))}×100

Images were also reproduced continuously on up to 6,000 sheets, and any scrape of the photosensitive member was measured using a film thickness meter to reveal that the scrape was only as small as 0 to 1 μm.

Example 2

Images were reproduced using the same apparatus and under the same conditions as in Example 1 except that the toner 2 was used as the toner and the OPC drum produced in Photosensitive Member Production Example 1 was used as the electrostatic latent image bearing member. In this image reproduction, the range of transfer bias within which 90% or more of transfer efficiency was achieved in the transfer from the photosensitive member to the transfer medium was 4 μA to 17 μA, showing a high transfer efficiency under a broad condition, and good images were formed which were free of blank areas caused by poor transfer in characters or lines and also free of black spots around the images.

Example 3

Images were reproduced using the same apparatus and under the same conditions as in Example 1 except that the toner 3 was used as the toner and the OPC drum produced in Photosensitive Member Production Example 1 was used as the electrostatic latent image bearing member. In this image reproduction, the range of transfer bias within which 90% or more of transfer efficiency was achieved in the transfer from the photosensitive member to the transfer medium was 4 μA to 16 μA, showing a high transfer efficiency under a broad condition, and good images were formed which were free of blank areas caused by poor transfer in characters or lines and also free of black spots around the images.

Example 4

Images were reproduced using the same apparatus and under the same conditions as in Example 1 except that the toner 4 was used as the toner and the OPC drum produced in Photosensitive Member Production Example 1 was used as the electrostatic latent image bearing member. In this image reproduction, the range of transfer bias within which 90% or more of transfer efficiency was achieved in the transfer from the photosensitive member to the transfer medium was 4 μA to 14 μA, showing a high transfer efficiency under a broad condition, and good images were formed which were free of blank areas caused by poor transfer in characters or lines and also free of black spots around the images.

Example 5

Images were reproduced using the same apparatus and under the same conditions as in Example 3 except that the toner 5 was used. In this image reproduction, the range of transfer bias within which 90% or more of transfer efficiency was achieved in the transfer from the photosensitive member to the transfer medium was 2 μA to 10 μA, showing a little lower efficiency than that in Example 1, but there was no particular problem in practical use and good images were formed which were free of blank areas caused by poor transfer in characters or lines and also free of black spots around the images.

Comparative Example 6A

Images were reproduced using the same apparatus and under the same conditions as in Example 3 except that the toner 6 was used. In this image reproduction, the range of transfer bias within which 90% or more of transfer efficiency was achieved in the transfer from the photosensitive member to the transfer medium was 2 μA to 8 μA, showing a little lower efficiency than that in Example 1, and blank areas caused by poor transfer were little seen on line images. There, however, was no particular problem in practical use, and good images free of black spots around the images were formed.

Comparative Example 7A

Images were reproduced using the same apparatus and under the same conditions as in Example 3 except that the toner 7 was used. In this image reproduction, the range of transfer bias within which 90% or more of transfer efficiency was achieved in the transfer from the photosensitive member to the transfer medium was 2 μA to 8 μA, showing a little lower efficiency than that in Example 1, and black spots around the images were slightly seen, but good images having no problem in practical use were formed.

Comparative Example 8A

Images were reproduced using the same apparatus and under the same conditions as in Example 2 except that the toner 12 was used. As a result, the range of transfer bias within which 90% or more of transfer efficiency was achieved in the transfer from the photosensitive member to the transfer medium was 2 μA to 6 μA, showing a little lower efficiency than that in Example 1, and black spots around the images were slightly seen, but good images having no problem in practical use were formed.

Comparative Example 1

Images were reproduced using the same apparatus and under the same conditions as in Example 2 except that the toner 8 was used. As a result, the range of transfer bias within which 90% or more of transfer efficiency was achieved in the transfer from the photosensitive member to the transfer medium was not present, and the toner was in a low utilization efficiency. Also, images having a little conspicuous blank areas caused by poor transfer in characters or lines were formed.

Comparative Example 2

Images were reproduced using the same apparatus and under the same conditions as in Comparative Example 1 except that the toner 9 was used and the OPC drum produced in Photosensitive Member Production Example 2 was used as the electrostatic latent image bearing member. As a result, the transfer bias at which 90% or more of transfer efficiency was achieved in the transfer from the photosensitive member to the transfer medium was only 8 μA, where no sufficient transfer latitude was attained. In addition, images formed had a low image density and were poor images with very many black spots around the images. Moreover, as a result of image reproduction on 500 sheets, faulty cleaning occurred on the photosensitive member.

Comparative Example 3

Images were reproduced using the same apparatus and under the same conditions as in Comparative Example 1 except that the toner 10 was used and the OPC drum produced in Photosensitive Member Production Example 2 was used as the electrostatic latent image bearing member. As a result, the transfer bias at which 90% or more of transfer efficiency was achieved in the transfer from the photosensitive member to the transfer paper was only 6 μA, where no sufficient transfer latitude was attained. In addition, images formed had a low image density and were poor images with very many black spots around the images.

Comparative Example 4

Images were reproduced using the same apparatus and under the same conditions as in Example 2 except that the toner 9 was used. As a result, the transfer bias at which 90% or more of transfer efficiency was achieved in the transfer from the photosensitive member to the transfer paper was only 8 μA, where no sufficient transfer latitude was attained. In addition, images formed had a low image density and, when images were reproduced on 300 sheets in an environment of 15° C./10% RH, faulty cleaning occurred on the photosensitive member.

Comparative Example 5

Images were reproduced using the same apparatus and under the same conditions as in Example 2 except that the toner 10 was used. As a result, the transfer bias at which 90% or more of transfer efficiency was achieved in the transfer from the photosensitive member to the transfer paper was only 6 μA, where no sufficient transfer latitude was attained. In addition, images formed had a low image density, many black spots around the images, a poor resolution, and many blank areas caused by poor transfer.

Comparative Example 6

Images were reproduced using the same apparatus and under the same conditions as in Example 2 except that the toner 11 was used. As a result, the range of transfer bias within which 90% or more of transfer efficiency was achieved in the transfer from the photosensitive member to the transfer paper was as narrow as 8 μA to 9 μA. In addition, images formed had a low image density, many black spots around the images, a poor resolution, and many blank areas caused by poor transfer.

Comparative Example 7

Images were reproduced using the same apparatus and under the same conditions as in Example 2 except that the toner 13 was used. As a result, the transfer bias at which 90% or more of transfer efficiency was achieved in the transfer from the photosensitive member to the transfer paper was only 6 μA, where no sufficient transfer latitude was attained. In addition, images formed had a low image density, many black spots around the images, a poor resolution, and many blank areas caused by poor transfer.

Example 9

As the image forming apparatus, the apparatus as schematically shown in FIGS. 1 and 2 was used.

As the electrostatic latent image bearing member, the organic photoconductor (OPC) photosensitive drum produced in Photosensitive Member Production Example 3 was used, and its dark portion potential $V_D$ and light portion potential $V_L$ were set at −550 V and −250 V, respectively. The gap between the photosensitive drum and the toner carrying member (developing sleeve) was set to be 300 μm. As the toner carrying member, a developing sleeve comprising an aluminum cylinder of 20 mm diameter with a blast-finished surface and formed thereon a resin layer having the following composition and having a layer thickness of about 7 μm and a JIS center-line average roughness (Ra) of 1.4 μm was used. The developing sleeve had a developing magnetic pole of 95 mT (950 gauss). As the toner coat control member, a urethane rubber blade of 1.0 mm thick and 10 mm in free length was brought into touch with the surface of the toner carrying member at a linear pressure of 14.7 N/m (15 g/cm).

| | |
|---|---|
| Phenol resin | 100 parts |
| Graphite (particle diameter: about 7 μm) | 90 parts |
| Carbon black | 10 parts |

Subsequently, as development bias, DC bias component Vdc of −400 V and superimposing AC bias component Vp-p of 1,500 V and f=2,000 Hz were used and development contrast ($V_L$-Vdc) was set at 150 V to carry out reverse development.

A transfer roller as shown in FIG. 4 [made of ethylene-propylene rubber with conductive carbon dispersed therein; volume resistivity of the conductive resilient layer: $10^8$ Ω·cm; surface-rubber hardness: 24 degrees; diameter: 20 mm; contact pressure: 49 N/m (50 g/cm)] was set rotary at a speed equal to the peripheral speed of the photosensitive drum (48 mm/sec) to perform printing.

As a toner, the magnetic toner 1 was used and images were continuously reproduced on 7,000 sheets in an environment of 15° C./10% RH. As a result, as shown in Table 2, good images were formed, having maintained a sufficient solid image density, free of ghost, black spots around the images and blank areas caused by poor transfer and having a high resolution.

In the present Example, the evaluation on the black spots around the images is made on minute fine lines concerned with the image quality of graphical images, and is evaluated on lines with 100 μm width, around which the black spots tend to occur more than characters and lines.

Figure 6:
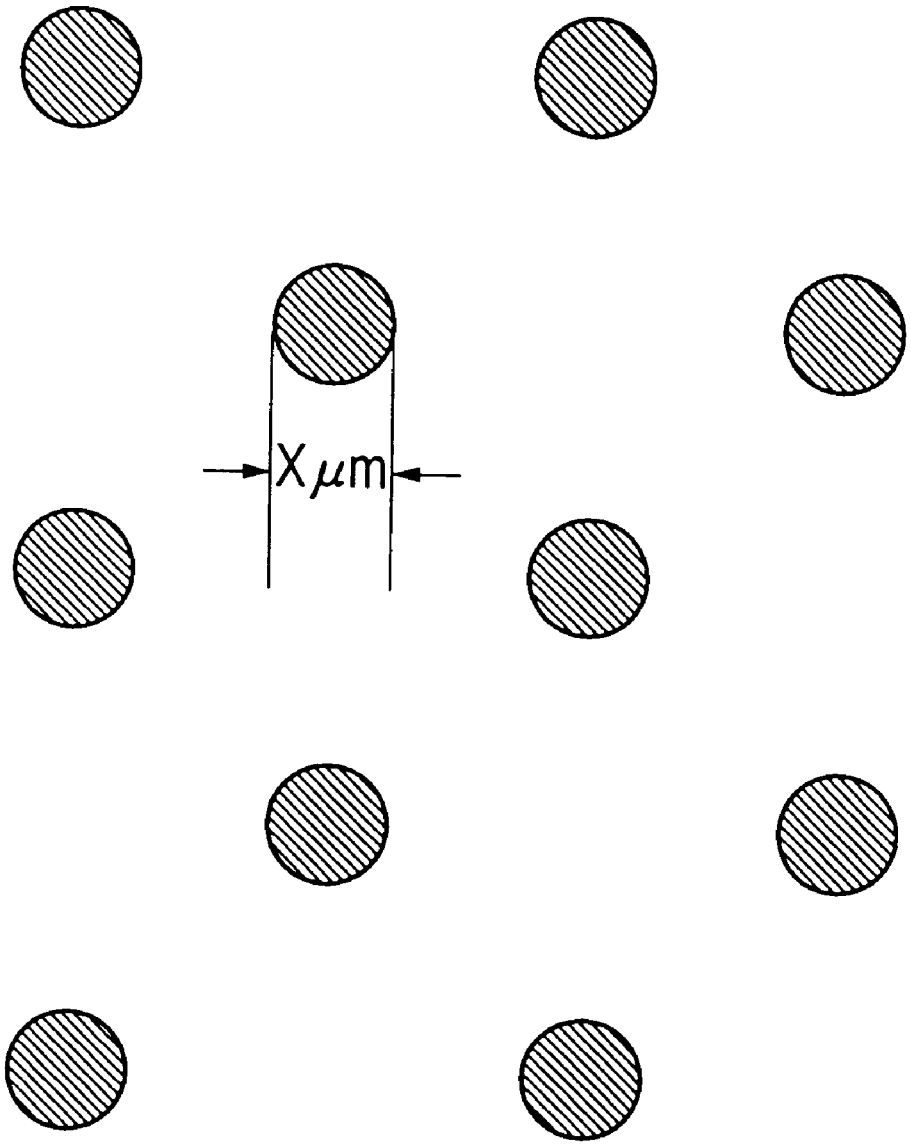
FIG. 6 illustrates an example of an isolated dot pattern used in the evaluation of resolution.

The resolution was evaluated by examining the reproducibility of small-diameter (X=50 μm diameter) isolated dots as shown in FIG. 6, which tend to form closed electric fields on account of latent image electric fields and are difficult to reproduce.

The evaluation on the blank areas caused by poor transfer is evaluation made when images are printed on cardboad (about 128 g/cm$^2$) which tends to cause blank areas caused by poor transfer.

The latitude of transfer performance (transfer latitude) was also evaluated by setting transfer bias variable between 2 μA to 20 μA in an environment of 32.5° C./80% RH. As transfer paper, paper with a basis weight of 75 g/m$^2$ was used. In this image reproduction, the range of transfer bias within which 90% or more of transfer efficiency was achieved in the transfer from the photosensitive member to the transfer medium was 4 μA to 18 μA, showing a high transfer efficiency under a broad condition, and good images were formed which were free of blank areas caused by poor transfer in characters or lines and also free of black spots around the images.

The transfer efficiency was determined in the manner described in Example 1.

Images were also reproduced continuously on up to 6,000 sheets, and any scrape of the photosensitive member was measured using a film thickness meter to reveal that the scrape was only as small as 0.5 μm.

Example 10

Images were reproduced using the same apparatus and under the same conditions as in Example 9 except that the toner 2 was used as the toner and the OPC drum produced in Photosensitive Member Production Example 1 was used as the electrostatic latent image bearing member. As a result, good results as shown in Table 2 were obtained.

Example 11

Images were reproduced using the same apparatus and under the same conditions as in Example 9 except that the toner 3 was used as the toner and the OPC drum produced in Photosensitive Member Production Example 1 was used as the electrostatic latent image bearing member, setting its dark portion potential $V_D$ light portion potential $V_L$ and development contrast ($V_L$-Vdc) at −550 V, −170 V and 230 V, respectively. As a result, good results as shown in Table 2 were obtained.

Example 12

Images were reproduced using the same apparatus and under the same conditions as in Example 11 except that the toner 4 was used as the toner and the OPC drum produced in Photosensitive Member Production Example 1 was used as the electrostatic latent image bearing member. As a result, good results as shown in Table 2 were obtained.

Example 13

Images were reproduced using the same apparatus and under the same conditions as in Example 11 except that the toner 5 was used and the OPC drum produced in Photosensitive Member Production Example 1 was used as the electrostatic latent image bearing member, setting its dark portion potential $V_D$ and light portion potential $V_L$ at −400 V, −100 V, respectively, using DC bias component Vdc of −300 V and superimposing AC bias component Vp-p of 1,600 V and f=1,800 Hz as development bias, and setting development contrast ($V_L$-Vdc) at 200 V. As a result, good results as shown in Table 2 were obtained.

Comparative Example 14A

Images were reproduced using the same apparatus and under the same conditions as in Example 11 except that the toner 6 was used. As a result, good results as shown in Table 2 were obtained.

Comparative Example 15A

Images were reproduced using the same apparatus and under the same conditions as in Example 11 except that the toner 7 was used. As a result, good results as shown in Table 2 were obtained.

Comparative Example 16A

Images were reproduced using the same apparatus and under the same conditions as in Example 11 except that the toner 12 was used. As a result, as shown in Table 2, good images having no problem on practical use were formed.

Comparative Example 8A

Images were reproduced using the same apparatus and under the same conditions as in Example 10 except that the toner 8 was used. As a result, the range of transfer bias within which 90% or more of transfer efficiency was achieved in the transfer from the photosensitive member to the transfer medium was not present, and the toner was in a low utilization efficiency. Also, images having a little conspicuous blank areas caused by poor transfer in characters or lines were formed.

Comparative Example 9

Images were reproduced using the same apparatus and under the same conditions as in Comparative Example 8 except that the toner 9 was used and the OPC drum produced in Photosensitive Member Production Example 2 was used as the electrostatic latent image bearing member. As a result, the transfer bias at which 90% or more of transfer efficiency was achieved in the transfer from the photosensitive member to the transfer medium was only 8 $\mu$A, where no sufficient transfer latitude was attained. In addition, images formed had a low image density and were poor images with very many black spots around the images. Moreover, as a result of image reproduction on 500 sheets, faulty cleaning occurred on the photosensitive member.

Comparative Example 10

Images were reproduced using the same apparatus and under the same conditions as in Comparative Example 8 except that the toner 10 was used and the OPC drum produced in Photosensitive Member Production Example 2 was used as the electrostatic latent image bearing member. As a result, the transfer bias at which 90% or more of transfer efficiency was achieved in the transfer from the photosensitive member to the transfer paper was only 6 $\mu$A, where no sufficient transfer latitude was attained. In addition, images formed had a low image density and were poor images with very many black spots around the images.

Comparative Example 11

Images were reproduced using the same apparatus and under the same conditions as in Example 10 except that the toner 9 was used. As a result, as shown in Table 2, faulty cleaning occurred on the 1,000th sheet in the evaluation in an environment of low temperature and low humidity, also showing a narrow transfer latitude.

Comparative Example 12

Images were reproduced using the same apparatus and under the same conditions as in Example 10 except that the toner 10 was used. As a result, as shown in Table 2, images formed had a low image density, many black spots around the images, a poor resolution, and many blank areas caused by poor transfer, also showing a narrow transfer latitude.

Comparative Example 13

Images were reproduced using the same apparatus and under the same conditions as in Example 10 except that the toner 11 was used. As a result, as shown in Table 2, images formed had a low image density, many black spots around the images, a poor resolution, and many blank areas caused by poor transfer.

Comparative Example 14

Images were reproduced using the same apparatus and under the same conditions as in Example 10 except that the toner 13 was used. As a result, as shown in Table 2, images formed had a low image density, many black spots around the images, a poor resolution, and many blank areas caused by poor transfer, also showing a narrow transfer latitude.

TABLE 2

| | | | | 7,000 sh. running, 15° C./10% RH | | | 32.5.° C./80% RH | |
|---|---|---|---|---|---|---|---|---|
| | Toner | Photo-sensi-tive member | Solid black image density | Black spots around line images | *2 Resolution | *3 Blank areas caused by poor transfer | Transfer current range for 90% or higher transfer efficiency (μA) | Scrape of photosensitive member after 6,000 sheet running (μm) |
| Example: | | | | | | | | |
| 9 | 1 | 3 | 1.55 | A | A | A | 4–18 | 0.5 |
| 10 | 2 | 1 | 1.54 | A | A | A | 4–17 | 1 |
| 11 | 3 | 1 | 1.53 | A | A | A | 4–16 | 1 |
| 12 | 4 | 1 | 1.53 | A | A | A | 4–14 | 1 |
| 13 | 5 | 1 | 1.53 | A | A | A | 2–10 | 1 |
| Compartive Example: | | | | | | | | |
| 14A | 6 | 1 | 1.52 | A | A | B | 2–8 | 1 |
| 15A | 7 | 1 | 1.51 | B | B | B | 2–8 | 1.5 |
| 16A | 12 | 1 | 1.43 | B | B | B | 2–6 | 1.8 |
| Comparative Example: | | | | | | | | |
| 8 | 8 | 2 | 1.35 | C | C | C | None | 2.5 |
| 9 | 9 | 2 | | -Faulty cleaning occurred on 500th sheet running- | | | 8 | — |
| 10 | 10 | 2 | 1.37 | C | C | C | 6 | 2.5 |
| 11 | 9 | 1 | | -Faulty cleaning occurred on 1,000th sheet running- | | | 8–9 | — |
| 12 | 10 | 1 | 1.39 | C | C | C | 6–7 | 2.0 |
| 13 | 11 | 1 | 1.37 | C | C | C | 2–4 | 1 |
| 14 | 13 | 1 | 1.35 | C | C | C | 6 | 2.3 |

*1: In the evaluation on black spots around the images, A: Very good, B: Good, and C: Black spots are conspicuous.

*2: In the evolution of resolution, A: Very good, B: Good, and C: Insufficient resolution.

*3: In the evalution on blank areas caused by poor transfer, A: Very good, B: Good, and C: Blank areas are conspicuous.

Example 17

As the image forming apparatus, the apparatus as schematically shown in FIG. 7 was used.

As color toners, cyan toner, magenta toner and yellow toner for CANON LBP-2030, and non-magnetic one-component developing assemblies were respectively used to carry out development.

As the photosensitive member, the one produced in Photosensitive Member Production Example 1 was used. As the magnetic toner, the toner 2 was used.

The range of transfer current (transfer bias) within which 90% or more of transfer efficiency was achieved in the transfer of toner images formed of three-color superimposed toner images was 12 μA to 20 μA. Also, the range of transfer current (transfer bias) in respect of toner images formed of the monochrome magnetic toner 2 was 4 μA to 18 μA.

In the formation of four-color full-color images with addition of the above magnetic toner, good images having no problem were formed at a transfer current value of 15 μA.

Comparative Example 15

Images were reproduced in the same manner as in Example 17 except that the magnetic toner was changed to the toner 10. Evaluation was made similarly. In the formation of four-color full-color images, only the black toner caused blank areas by poor transfer, an inferior resolution and a poor transfer performance.

What is claimed is:

1. A toner for developing an electrostatic image comprising toner particles containing at least a binder resin and a colorant, and an inorganic fine powder, wherein;

said toner has at least one endothermic peak in the temperature region of 120° C. or below in differential thermal analysis; and said toner has, in its particles having particle diameters of 3 μm or larger, not less than 93% by number of particles having a circularity a of at least 0.90 and less than 30% by number of particles having a circularity a of at least 0.98, the circularity being found from the following expression (1):

$$\text{Circularity } a = Lo/L \quad (1)$$

wherein Lo represents a circumferential length of a circle having the same projected area as a particle image, and L represents a circumferential length of a projected image of a particle.

2. The toner according to claim 1, wherein said toner has, in its particles having particle diameters of 3 μm or larger, a standard deviation SD of circularity distribution, of 0.045 or less as a value found from the following expression (2);

$$\text{Standard deviation } SD = \sqrt{\sum (a_i - \bar{a})^2 / (n-1)} \quad (2)$$

wherein $a_i$ represents a circularity of of each particle, $\bar{a}$ represents an average circularity, and n represents the number of whole particles.

3. The toner according to claim 2, wherein said toner has, in its particles having particle diameters of 3 μm or larger, a standard deviation SD of circularity distribution, of 0.040 or less.

4. The toner according to claim 1, wherein said toner has a weight-average particle diameter of 10.0 μm or smaller.

5. The toner according to claim 1, wherein said toner has a weight-average particle diameter of 8.0 μm or smaller.

6. The toner according to claim 1, wherein said toner has at least one endothermic peak in the temperature region of from 60° C. to 120° C. in differential thermal analysis.

7. The toner according to claim 1, wherein said toner has at least one endothermic peak in the temperature region of from 70° C. to 120° C. in differential thermal analysis.

8. The toner according to claim 1, wherein said toner has at least one endothermic peak in the temperature region of 110° C. or below in differential thermal analysis.

9. The toner according to claim 1, wherein said toner contains a substance having at least one endothermic peak in the temperature region of 120° C. or below in differential thermal analysis.

10. The toner according to claim 9, wherein said substance comprises a resin.

11. The toner according to claim 10, wherein said resin comprises a polyester resin or silicone resin having a crystallinity.

12. The toner according to claim 9, wherein said substance comprises a wax.

13. The toner according to claim 12, wherein said wax comprises a wax selected from the group consisting of a polyolefin wax, a hydrocarbon wax, a petroleum wax and a higher alcohol.

14. The toner according to claim 1, wherein said binder resin has, in its molecular weight distribution as measured by gel permeation chromatography, a main peak in a molecular weight region exceeding a molecular weight of 15,000.

15. The toner according to claim 14, wherein said binder resin has a component having a molecular weight of not more than 10,000, in a content of 25% or less.

16. The toner according to claim 1, wherein said binder resin has, in its molecular weight distribution as measured by gel permeation chromatography, a main peak in a molecular weight region exceeding a molecular weight of 15,000 and no peak or shoulder in a molecular weight region of not more than a molecular weight of 15,000, and has a component having a molecular weight of not more than 10,000, in a content of 25% or less.

17. The toner according to claim 1, wherein said toner is a magnetic toner having magnetic toner particles containing a magnetic material as the colorant.

18. The toner according to claim 1, wherein said inorganic fine powder comprises silica, alumina, titanium or a double oxide of any of these.

19. The toner according to claim 1, wherein said toner particles have been made spherical by applying at least a mechanical impact.

20. An image forming method comprising the steps of:

electrostatically charging an electrostatic latent image bearing member;

forming an electrostatic latent image on the electrostatic latent image bearing member thus charged;

developing the electrostatic latent image by the use of a toner carried on a toner carrying member, to form a toner image on the electrostatic latent image bearing member; and bringing a transfer member to which a voltage is applied, into contact with a transfer medium to transfer to the transfer medium the toner image held on the electrostatic latent image bearing member;

said toner comprising toner particles containing at least a binder resin and a colorant, and an inorganic fine powder, wherein;

said toner has at least one endothermic peak in the temperature region of 120° C. or below in differential thermal analysis; and said toner has, in its particles having particle diameters of 3 μm or larger, not less than 93% by number of particles having a circularity $\dot{a}$ of at least 0.90 and less than 30% by number of particles having a circularity $\dot{a}$ of at least 0.98, the circularity being found from the following expression (1):

$$\text{Circularity } \dot{a} = Lo/L \quad (1)$$

wherein Lo represents a circumferential length of a circle having the same projected area as a particle image, and L represents a circumferential length of a projected image of a particle.

21. The method according to claim 20, wherein said electrostatic latent image has a potential contrast of 400 V or below.

22. The method according to claim 20, wherein said electrostatic latent image has a potential contrast of 350 V or below.

23. The method according to claim 20, wherein said electrostatic latent image bearing member comprises an electrophotographic photosensitive member.

24. The method according to claim 20, wherein a layer of said toner is formed on said toner carrying member by means of a toner layer thickness control member elastically coming into touch with the surface of said toner carrying member.

25. The method according to claim 20, wherein the surface of said electrostatic latent image bearing member has a contact angle to water, of 85 degrees or more.

26. The method according to claim 25, wherein said electrostatic latent image bearing member contains a fluorine-containing substance in its surface.

27. The method according to claim 26, wherein said fluorine-containing substance comprises a fluorine-containing fine powder.

28. The method according to claim 20, wherein said toner has, in its particles having particle diameters of 3 μm or larger, a standard deviation SD of circularity distribution, of 0.045 or less as a value found from the following expression (2)

$$\text{Standard deviation } SD = \sqrt{\sum (a_i - \bar{a})^2 / (n-1)} \quad (2)$$

wherein $a_i$ represents a circularity of of each particle, $\bar{a}$ represents an average circularity, and n represents the number of whole particles.

29. The method according to claim 28, wherein said toner has, in its particles having particle diameters of 3 μm or larger, a standard deviation SD of circularity distribution, of 0.040 or less.

30. The method according to claim 20, wherein said toner has a weight-average particle diameter of 10.0 μm or smaller.

31. The method according to claim 20, wherein said toner has a weight-average particle diameter of 8.0 μm or smaller.

32. The method according to claim 20, wherein said toner has at least one endothermic peak in the temperature region of from 60° C. to 120° C. in differential thermal analysis.

33. The method according to claim 20, wherein said toner has at least one endothermic peak in the temperature region of from 70° C. to 120° C. in differential thermal analysis.

34. The method according to claim 20, wherein said toner has at least one endothermic peak in the temperature region of 110° C. or below in differential thermal analysis.

35. The method according to claim 20, wherein said toner contains a substance having at least one endothermic peak in the temperature region of 120° C. or below in differential thermal analysis.

36. The method according to claim 35, wherein said substance comprises a resin.

37. The method according to claim 36, wherein said resin comprises a polyester resin or silicone resin having a crystallizability.

38. The method according to claim 35, wherein said substance comprises a wax.

39. The method according to claim 38, wherein said wax comprises a wax selected from the group consisting of a polyolefin wax, a hydrocarbon wax, a petroleum wax and a higher alcohol.

40. The method according to claim 20, wherein said binder resin has, in its molecular weight distribution as measured by gel permeation chromatography, a main peak in a molecular weight region exceeding a molecular weight of 15,000.

41. The method according to claim 40, wherein said binder resin has a component having a molecular weight of not more than 10,000, in a content of 25% or less.

42. The method according to claim 20, wherein said binder resin has, in its molecular weight distribution as measured by gel permeation chromatography, a main peak in a molecular weight region exceeding a molecular weight of 15,000 and no peak or shoulder in a molecular weight region of not more than a molecular weight of 15,000, and has a component having a molecular weight of not more than 10,000, in a content of 25% or less.

43. The method according to claim 20, wherein said toner is a magnetic toner having magnetic toner particles containing a magnetic material as the colorant.

44. The method according to claim 20, wherein said inorganic fine powder comprises silica, alumina, titanium or a double oxide of any of these.

45. The method according to claim 20, wherein said toner particles have been made spherical by applying at least a mechanical impact.

46. An image forming method comprising the steps of:

electrostatically charging an electrostatic latent image bearing member;

forming an electrostatic latent image on the electrostatic latent image bearing member thus charged;

developing the electrostatic latent image by the use of a toner carried on a toner carrying member, to form a toner image on the electrostatic latent image bearing member;

primarily transferring the toner image held on the electrostatic latent image bearing member, to an intermediate transfer member; and bringing a transfer member to which a voltage is applied, into contact with a recording medium to secondarily transfer to the recording medium the toner image held on the intermediate transfer member;

said toner comprising toner particles containing at least a binder resin and a colorant, and an inorganic fine powder, wherein;

said toner has at least one endothermic peak in the temperature region of 120° C. or below in differential thermal analysis; and said toner has, in its particles having particle diameters of 3 μm or larger, not less than 93% by number of particles having a circularity $\dot{a}$ of at least 0.90 and less than 30% by number of particles having a circularity $\dot{a}$ of at least 0.98, the circularity being found from the following expression (1):

$$\text{Circularity } \dot{a}=Lo/L \tag{1}$$

wherein Lo represents a circumferential length of a circle having the same projected area as a particle image, and L represents a circumferential length of a projected image of a particle.

47. The method according to claim 46, wherein said electrostatic latent image has a potential contrast of 400 V or below.

48. The method according to claim 46, wherein said electrostatic latent image has a potential contrast of 350 V or below.

49. The method according to claim 46, wherein said electrostatic latent image bearing member comprises an electrophotographic photosensitive member.

50. The method according to claim 46, wherein a layer of said toner is formed on said toner carrying member by means of a toner layer thickness control member elastically coming into touch with the surface of said toner carrying member.

51. The method according to claim 46, wherein the surface of said electrostatic latent image bearing member has a contact angle to water, of 85 degrees or more.

52. The method according to claim 51, wherein said electrostatic latent image bearing member contains a fluorine-containing substance in its surface.

53. The method according to claim 52, wherein said fluorine-containing substance comprises a fluorine-containing fine powder.

54. The method according to claim 46, wherein said toner has, in its particles having particle diameters of 3 μm or larger, a standard deviation SD of circularity distribution, of 0.045 or less as a value found from the following expression (2).

$$\text{Standard deviation } SD = \sqrt{\sum (a_i - \bar{a})^2 / (n-1)} \tag{2}$$

wherein $a_i$ represents a circularity of of each particle, $\bar{a}$ represents an average circularity, and n represents the number of whole particles.

55. The method according to claim 54, wherein said toner has, in its particles having particle diameters of 3 μm or larger, a standard deviation SD of circularity distribution, of 0.040 or less.

56. The method according to claim 46, wherein said toner has a weight-average particle diameter of 10.0 μm or smaller.

57. The method according to claim 46, wherein said toner has a weight-average particle diameter of 8.0 μm or smaller.

58. The method according to claim 46, wherein said toner has at least one endothermic peak in the temperature region of from 60° C. to 120° C. in differential thermal analysis.

59. The method according to claim 46, wherein said toner has at least one endothermic peak in the temperature region of from 70° C. to 120° C. in differential thermal analysis.

60. The method according to claim 46, wherein said toner has at least one endothermic peak in the temperature region of 110° C. or below in differential thermal analysis.

61. The method according to claim 46, wherein said toner contains a substance having at least one endothermic peak in the temperature region of 120° C. or below in differential thermal analysis.

62. The method according to claim 61, wherein said substance comprises a resin.

63. The method according to claim 62, wherein said resin comprises a polyester resin or silicone resin having a crystallizability.

64. The method according to claim 61, wherein said substance comprises a wax.

65. The method according to claim 64, wherein said wax comprises a wax selected from the group consisting of a polyolefin wax, a hydrocarbon wax, a petroleum wax and a higher alcohol.

66. The method according to claim 46, wherein said binder resin has, in its molecular weight distribution as measured by gel permeation chromatography, a main peak in a molecular weight region exceeding a molecular weight of 15,000.

67. The method according to claim 66, wherein said binder resin has a component having a molecular weight of not more than 10,000, in a content of 25% or less.

68. The method according to claim 46, wherein said binder resin has, in its molecular weight distribution as measured by gel permeation chromatography, a main peak in a molecular weight region exceeding a molecular weight of 15,000 and no peak or shoulder in a molecular weight region of not more than a molecular weight of 15,000, and has a component having a molecular weight of not more than 10,000, in a content of 25% or less.

69. The method according to claim 46, wherein said toner is a magnetic toner having magnetic toner particles containing a magnetic material as the colorant.

70. The method according to claim 46, wherein said inorganic fine powder comprises silica, alumina, titanium or a double oxide of any of these.

71. The method according to claim 46, wherein said toner particles have been made spherical by applying at least a mechanical impact.

72. The method according to claim 46, wherein;

said toner is a magnetic toner having magnetic toner particles containing a magnetic material as the colorant; and said magnetic toner is used together with a non-magnetic toner selected from the group consisting of a non-magnetic cyan toner, a non-magnetic yellow toner and a non-magnetic magenta toner, where color toner images having been primarily transferred onto said intermediate transfer member are secondarily transferred to said recording medium at one time to form a color toner image having the magnetic toner and non-magnetic color toners.

73. A magnetic toner for developing an electrostatic image comprising magnetic toner particles containing at least a binder resin and a magnetic material, and an inorganic fine powder, wherein; said magnetic toner has at least one endothermic peak in the temperature region of 120° C. or below in differential thermal analysis;

said magnetic toner has, in its particles having particle diameters of 3 μm or larger, not less than 93% by number of particles having a circularity $\dot{a}$ of at least 0.90 and less than 30% by number of particles having a circularity $\dot{a}$ of at least 0.98, the circularity being found from the following expression (1):

$$\text{Circularity } \dot{a}=Lo/L \quad (1)$$

wherein Lo represents a circumferential length of a circle having the same projected area as a particle image, and L represents a circumferential length of a projected image of a particle; and said inorganic fine powder has been treated with silicone oil.

74. The magnetic toner according to claim 73, wherein said magnetic toner particles contain said magnetic material in a content of from 30 to 200 parts by weight based an 100 parts by weight of the binder resin.

75. The magnetic toner according to claim 73, wherein said magnetic toner has, in its particles having particle diameters of 3 μm or larger, a standard deviation SD of circularity distribution, of 0.045 or less as a value found from the following expression (2):

$$\text{Standard deviation } SD = \sqrt{\sum (a_i - \bar{a})^2 / (n-1)} \quad (2)$$

wherein $a_i$ represents a circularity of each particle, $\bar{a}$ represents an average circularity, and n represents the number of whole particles.

76. The magnetic toner according to claim 75, wherein said magnetic toner has, in its particles having particle diameters of 3 μm or larger, a standard deviation SD of circularity distribution, of 0.040 or less.

77. The magnetic toner according to claim 73, wherein said magnetic toner has a weight-average particle diameter of 10.0 μm or smaller.

78. The magnetic toner according to claim 73, wherein said magnetic toner has a weight-average particle diameter of 8.0 μm or smaller.

79. The magnetic toner according to claim 73, wherein said magnetic toner has at least one endothermic peak in the temperature region from 60° C. to 120° C. in differential thermal analysis.

80. The magnetic toner according to claim 73, wherein said magnetic toner has at least one endothermic peak in the temperature region from 70° C. to 120° C. in differential thermal analysis.

81. The magnetic toner according to claim 73, wherein said magnetic toner has at least one endothermic peak in the temperature region of 110° C. or below in differential thermal analysis.

82. The magnetic toner according to claim 73, wherein said magnetic toner contains a substance having at least one endothermic peak in the temperature region of 120° C. or below in differential thermal analysis.

83. The magnetic toner according to claim 82, wherein said substance comprises a resin.

84. The magnetic toner according to claim 83, wherein said resin comprises a polyester resin or silicone resin having a crystallinity.

85. The magnetic toner according to claim 82, wherein said substance comprises a wax.

86. The magnetic toner according to claim 85, wherein said wax comprises a wax selected from the group consisting of a polyolefin wax, a hydrocarbon wax, a petroleum wax and a higher alcohol.

87. The magnetic toner according to claim 73, wherein said binder resin has, in its molecular weight distribution as measured by gel permeation chromatography, a main peak in a molecular weight region exceeding a molecular weight of 15,000.

88. The magnetic toner according to claim 87, wherein said binder resin has a component having a molecular weight of not more than 10,000, in a content of 25% or less.

89. The magnetic toner according to claim 73, wherein said binder resin has, in its molecular weight distribution as measured by gel permeation chromatography, a main peak in a molecular weight region exceeding a molecular weight of 15,000 and no peak or shoulder in a molecular weight region of not more than a molecular weight of 15,000, and has a component having a molecular weight of not more than 10,000, in a content of 25% or less.

90. The magnetic toner according to claim 73, wherein said inorganic fine powder comprises silica, alumina, titanium or a double oxide thereof.

91. The magnetic toner according to claim 73, wherein said magnetic toner particles have been made spherical by applying at least a mechanical impact.

92. A magnetic toner for developing an electrostatic image comprising magnetic toner particles containing at least a binder resin and a magnetic material, and an inorganic fine powder, wherein;

said magnetic toner has at least one endothermic peak in the temperature region of 120° C. or below in differential thermal analysis;

said magnetic toner has, in its particles having particle diameters of 3 μm or larger, not less than 93% by number of particles having a circularity $\dot{a}$ of at least 0.90 and less than 30% by number f particles having a circularity $\dot{a}$ of at least 0.98, the circularity being found from the following expression (1):

$$\text{Circularity } \dot{a}=Lo/L \quad (1)$$

wherein Lo represents a circumferential length of a circle having the same projected area as a particle image, and L represents a circumferential length of a projected image of a particle; and said magnetic toner has a weight-average particle diameter of 8.0 μm or smaller.

93. The magnetic toner according to claim 92, wherein said magnetic toner has a weight-average particle diameter from 3.0 μm to 8.0 μm.

94. The magnetic toner according to claim 92, wherein said magnetic toner particles contain said magnetic material in a content from 30 to 200 parts by weight based on 100 parts by weight of the binder resin.

95. The magnetic toner according to claim 92, wherein said magnetic toner has, in its particles having 113 particle diameters of 3 μm or larger, a standard deviation SD of circularity distribution, of 0.045 or less as a value found from the following expression (2):

$$\text{Standard deviation } SD = \sqrt{\sum (a_i - \bar{a})^2 / (n-1)} \quad (2)$$

wherein $a_i$ represents a circularity of each particle, $\dot{a}$ represents an average circularity, and n represents the number of whole particles.

96. The magnetic toner according to claim 95, wherein said magnetic toner has, in its particles having particle diameters of 3 μm or larger, a standard deviation SD of circularity distribution, of 0.040 or less.

97. The magnetic toner according to claim 92, wherein said magnetic toner has at least one endothermic peak in the temperature region of from 60° C. to 120° C. in differential thermal analysis.

98. The magnetic toner according to claim 92, wherein said magnetic toner has at least one endothermic peak in the temperature region of from 70° C. to 120° C. in differential thermal analysis.

99. The magnetic toner according to claim 92, wherein said magnetic toner has at least one endothermic peak in the temperature region of 110° C. or below in differential thermal analysis.

100. The magnetic toner according to claim 92, wherein said magnetic toner contains a substance having at least one endothermic peak in the temperature region of 120° C. or below in differential thermal analysis.

101. The magnetic toner according to claim 100, wherein said substance comprises a resin.

102. The magnetic toner according to claim 101, wherein said resin comprises a polyester resin or silicone resin having a crystallinity.

103. The magnetic toner according to claim 100, wherein said substance comprises a wax.

104. The magnetic toner according to claim 103, wherein said wax comprises a wax selected from the group consisting of a polyolefin wax, a hydrocarbon wax, a petroleum wax and a higher alcohol.

105. The magnetic toner according to claim 92, wherein said binder resin has, in its molecular weight distribution as measured by gel permeation chromatography, a main peak in a molecular weight region exceeding a molecular weight of 15,000.

106. The magnetic toner according to claim 105, wherein said binder resin has a component having a molecular weight of not more than 10,000, in a content of 25% or less.

107. The magnetic toner according to claim 92, wherein said binder resin has, in its molecular weight distribution as measured by gel permeation chromatography, a main peak in a molecular weight region exceeding a molecular weight of 15,000 and no peak or shoulder in a molecular weight region of not more than a molecular weight of 15,000, and has a component having a molecular weight of not more than 10,000, in a content of 25% or less.

108. The magnetic toner according to claim 92, wherein said inorganic fine powder comprises silica, alumina, titanium or a double oxide thereof.

109. The magnetic toner according to claim 92, wherein said magnetic toner particles have been made spherical by applying at least a mechanical impact.

110. An image forming method comprising the steps of:

electrostatically charging an electrostatic latent image bearing member;

forming an electrostatic latent image on the electrostatic latent image bearing member thus charged;

developing the electrostatic latent image by the use of a magnetic toner carried on a toner carrying member, to form a toner image on the electrostatic latent image bearing member; and bringing a transfer member to which a voltage is applied, into contact with a transfer medium to transfer to the transfer medium the toner image held on the electrostatic latent image bearing member;

said magnetic toner comprising magnetic toner particles containing at least a binder resin and a magnetic material, and an inorganic fine powder, wherein, said magnetic toner has at least one endothermic peak in the temperature region of 120° C. or below in differential thermal analysis;

said magnetic toner has, in its particles having particle diameters of 3 μm or larger, not less than 93% by number of particles having a circularity $\dot{a}$ of at least 0.90 and less than 30% by number of particles having a circularity $\dot{a}$ of at least 0.98, the circularity being found from the following expression (1):

$$\text{Circularity } \dot{a}=Lo/L \quad (1)$$

wherein Lo represents a circumferential length of a circle having the same projected area as a particle image, and L represents a circumferential length of a projected Image of a particle; and said inorganic fine powder has been treated with silicone oil.

111. The method according to claim 110, wherein said electrostatic latent image has a potential contrast of 400 V or below.

112. The method according to claim 110, wherein said electrostatic latent image has a potential contrast of 350 V or below.

113. The method according to claim 110, wherein said electrostatic latent image bearing member comprises an electrophotographic photosensitive member.

114. The method according to claim 110, wherein a layer of said toner is formed on said toner carrying member by means of a toner layer thickness control member elastically coming into touch with the surface of said toner carrying member.

115. The method according to claim 110, wherein the surface of said electrostatic latent image bearing member has a contact angle to water, of 85 degrees or more.

116. The method according to claim 115, wherein said electrostatic latent image bearing member contains a fluorine-containing substance in its surface.

117. The method according to claim 116, wherein said fluorine-containing substance comprises a fluorine-containing fine powder.

118. The method according to claim 110, wherein said magnetic toner particles contain said magnetic material in a content of from 30 to 200 parts by weight based on 100 parts by weight of the binder resin.

119. The method according to claim 110, wherein said magnetic toner has, in its particles having particle diameters of 3 $\mu$m or larger, a standard deviation SD of circularity distribution, of 0.045 or less as a value found from the following expression (2):

$$\text{Standard deviation } SD = \sqrt{\sum (a_i - \bar{a})^2 / (n-1)} \quad (2)$$

wherein $a_i$ represents a circularity of each particle, $\bar{a}$ represents an average circularity, and n represents the number of whole particles.

120. The method according to claim 119, wherein said magnetic toner has, in its particles having particle diameters of 3 $\mu$m or larger, a standard deviation SD of circularity distribution, of 0.040 or less.

121. The method according to claim 110, wherein said magnetic toner has a weight-average particle diameter of 10.0 $\mu$m or smaller.

122. The method according to claim 110, wherein said magnetic toner has a weight-average particle diameter of 8.0 $\mu$m or smaller.

123. The method according to claim 110, wherein said magnetic toner has at least one endothermic peak in the temperature region of from 60° to 120° C. in differential thermal analysis.

124. The method according to claim 110, wherein said magnetic toner has at least one endothermic peak in the temperature region of from 70° C. to 120° C. in differential thermal analysis.

125. The method according to claim 110, wherein said magnetic toner has at least one endothermic peak in the temperature region of 110° C. or below in differential thermal analysis.

126. The method according to claim 110, wherein said magnetic toner contains a substance having at least one endothermic peak in the temperature region of 120° C. or below in differential thermal analysis.

127. The method according to claim 126, wherein said substance comprises a resin.

128. The method according to claim 127, wherein said resin comprises a polyester resin or silicone resin having a crystallizability.

129. The method according to claim 126, wherein said substance comprises a wax.

130. The method according to claim 129, wherein said wax comprises a wax selected from the group consisting of a polyolefin wax, a hydrocarbon wax, a petroleum wax and a higher alcohol.

131. The method according to claim 110, wherein said binder resin has, in its molecular weight distribution as measured by gel permeation chromatography, a main peak in a molecular weight region exceeding a molecular weight of 15,000.

132. The method according to claim 131, wherein said binder resin has a component having a molecular weight of not more than 10,000, in a content of 25% or less.

133. The method according to claim 110, wherein said binder resin has, in its molecular weight distribution as measured by gel permeation chromatography, a main peak in a molecular weight region exceeding a molecular weight of 15,000 and no peak or shoulder in a molecular weight region of not more than a molecular weight of 15,000, and has a component having a molecular weight of not more than 10,000, in a content of 25% or less.

134. The method according to claim 110, wherein said inorganic fine powder comprises silica, alumina, titanium or a double oxide thereof.

135. The method according to claim 110, wherein said magnetic toner particles have been made spherical by applying at least a mechanical impact.

136. An image forming method comprising the steps of:

electrostatically charging an electrostatic latent image bearing member;

forming an electrostatic latent image on the electrostatic latent image bearing member thus charged;

developing the electrostatic latent image by the use of a magnetic toner carried on a toner carrying member, to form a toner image on the electrostatic latent image bearing member; and bringing a transfer member to which a voltage is applied, into contact with a transfer medium to transfer to the transfer medium the toner image held on the electrostatic latent image bearing member;

said magnetic toner comprising magnetic toner particles containing at least a binder resin and a magnetic material, and an inorganic fine powder, wherein;

said magnetic toner has at least one endothermic peak in the temperature region of 120° C. or below in differential thermal analysis;

said magnetic toner has, in its particles having particle diameters of 3 $\mu$m or larger, not less than 93% by number of particles having a circularity $\dot{a}$ of at least 0.90 and less than 30% by number of particles having a circularity $\dot{a}$ of at least 0.98, the circularity being found from the following expression (1):

$$\text{Circularity } \dot{a} = Lo/L \quad (1)$$

wherein Lo represents a circumferential length of a circle having the same projected area as a particle image, and L represents a circumferential length of a projected image of a particle; and said magnetic toner has a weight-average particle diameter of 8.0 $\mu$m or smaller.

137. The method according to claim 136, wherein said electrostatic latent image has a potential contrast of 400 V or below.

138. The method according to claim 136, wherein said electrostatic latent image has a potential contrast of 350 V or below.

139. The method according to claim 136, wherein said electrostatic latent image bearing member comprises an electrophotographic photosensitive member.

140. The method according to claim 136, wherein a layer of said toner is formed on said toner carrying member by means of a toner layer thickness control member elastically touching the surface of said toner carrying member.

141. The method according to claim 136, wherein the surface of said electrostatic latent image bearing member has a contact angle to water, of 85 degrees or more.

142. The method according to claim 141, wherein said electrostatic latent image bearing member contains a fluorine-containing substance in its surface.

143. The method according to claim 142, wherein said fluorine-containing substance comprises a fluorine-containing fine powder.

144. The method according to claim 136, wherein said magnetic toner has a weight-average particle diameter of from 3.0 $\mu$m. to 8.0 $\mu$m.

145. The method according to claim 136, wherein said magnetic toner particles contain said magnetic material in a content of from 30 to 200 parts by weight based on 100 parts by weight of the binder resin.

146. The method according to claim 136, wherein said magnetic toner has, in its particles having particle diameters of 3 $\mu$m or larger, a standard deviation SD of circularity distribution, of 0.045 or less as a value found from the following expression (2):

$$\text{Standard deviation } SD = \sqrt{\sum (a_i - \bar{a})^2 / (n-1)} \quad (2)$$

wherein $a_i$ represents a circularity of each particle, $\bar{a}$ represents an average circularity, and n represents the number of whole particles.

147. The method according to claim 146, wherein said magnetic toner has, in its particles having particle diameters of 3 $\mu$m or larger, a standard deviation SD of circularity distribution, of 0.040 or less.

148. The method according to claim 136, wherein said magnetic toner has at least one endothermic peak in the temperature region of from 60° C. to 120° C. in differential thermal analysis.

149. The method according to claim 136, wherein said magnetic toner has at least one endothermic peak in the temperature region of from 70° C. to 120° C. in differential thermal analysis.

150. The method according to claim 136, wherein said magnetic toner has at least one endothermic peak in the temperature region of 110° C. or below in differential thermal analysis.

151. The method according to claim 136, wherein said magnetic toner contains a substance having at least one endothermic peak in the temperature region of 120° C. or below in differential thermal analysis.

152. The method according to claim 151, wherein said substance comprises a resin.

153. The method according to claim 152, wherein said resin comprises a polyester resin or silicone resin having a crystallizability.

154. The method according to claim 151, wherein said substance comprises a wax.

155. The method according to claim 154, wherein said wax comprises a wax selected from the group consisting of a polyolefin wax, a hydrocarbon wax, a petroleum wax and a higher alcohol.

156. The method according to claim 136, wherein said binder resin has, in its molecular weight distribution as measured by gel permeation chromatography, a main peak in a molecular weight region exceeding a molecular weight of 15,000.

157. The method according to claim 156, wherein said binder resin has a component having a molecular weight of not more than 10,000, in a content of 25% or less.

158. The method according to claim 136, wherein said binder resin has, in its molecular weight distribution as measured by gel permeation chromatography, a main peak in a molecular weight region exceeding a molecular weight of 15,000 and no peak or shoulder in a molecular weight region of not more than a molecular weight of 15,000, and has a component having a molecular weight of not more than 10,000, in a content of 25% or less.

159. The method according to claim 136, wherein said inorganic fine powder comprises silica, alumina, titanium or a double oxide thereof.

160. The method according to claim 136, wherein said magnetic toner particles have been made spherical by applying at least a mechanical impact.

161. An image forming method comprising the steps of:

electrostatically charging an electrostatic latent image bearing member;

forming an electrostatic latent image on the electrostatic latent image bearing member thus charged;

developing the electrostatic latent image by the use of a magnetic toner carried on a toner carrying member, to form a toner image on the electrostatic latent image bearing member;

primarily transferring the toner image held on the electrostatic latent image bearing member, to an intermediate transfer member; and bringing a transfer member to which a voltage is applied, into contact with a recording medium to secondarily transfer to the recording medium the toner image held on the intermediate transfer member;

said magnetic toner comprising magnetic toner particles containing at least a binder resin and a magnetic material, and an inorganic fine powder, wherein;

said magnetic toner has at least one endothermic peak in the temperature region of 120° C. or below in differential thermal analysis;

said magnetic toner has, in its particles having particle diameters of 3 $\mu$m or larger, not less than 93% by number of particles having a circularity $\dot{a}$ of at least 0.90 and less than 30% by number of particles having a circularity $\dot{a}$ of at least 0.98, the circularity being found from the following expression (1):

$$\text{Circularity } \dot{a} = Lo/L \quad (1)$$

wherein Lo represents a circumferential length of a circle having the same projected area as a particle image, and L represents a circumferential length of a projected image of a particle; and said inorganic fine powder has been treated with silicone oil.

162. The method according to claim 161, wherein said electrostatic latent image has a potential contrast of 400 V or below.

163. The method according to claim 161, wherein said electrostatic latent image has a potential contrast of 350 V or below.

164. The method according to claim 161, wherein said electrostatic latent image bearing member comprises an electrophotographic photosensitive member.

165. The method according to claim 161, wherein a layer of said toner is formed on said toner carrying member by means of a toner layer thickness control member elastically touching the surface of said toner carrying member.

166. The method according to claim 161, wherein the surface of said electrostatic latent image bearing member has a contact angle to water, of 85 degrees or more.

167. The method according to claim 166, wherein said electrostatic latent image bearing member contains a fluorine-containing substance in its surface.

168. The method according to claim 167, wherein said fluorine-containing substance comprises a fluorine-containing fine powder.

169. The method according to claim 143, wherein said magnetic toner particles contain said magnetic material in a content of from 30 to 200 parts by weight based on 100 parts by weight of the binder resin.

170. The method according to claim 143, wherein said magnetic toner has, in its particles having particle diameters of 3 $\mu$m or larger, a standard deviation SD of circularity distribution, of 0.045 or less as a value found from the following expression (2):

$$\text{Standard deviation } SD = \sqrt{\sum (a_i - \bar{a})^2 / (n-1)} \quad (2)$$

wherein $a_i$ represents a circularity of each particle, $\bar{a}$ represents an average circularity, and n represents the number of whole particles.

171. The method according to claim 170, wherein said magnetic toner has, in its particles having particle diameters of 3 $\mu$m or larger, a standard deviation SD of circularity distribution, of 0.040 or less.

172. The method according to claim 161, wherein said magnetic toner has a weight-average particle diameter of 10.0 $\mu$m or smaller.

173. The method according to claim 161, wherein said magnetic toner has a weight-average particle diameter of 8.0 $\mu$m or smaller.

174. The method according to claim 161, wherein said magnetic toner has at least one endothermic peak in the temperature region of from 60° C. to 120° C. in differential thermal analysis.

175. The method according to claim 161, wherein said magnetic toner has at least one endothermic peak in the temperature region of from 70° C. to 120° C. in differential thermal analysis.

176. The method according to claim 161, wherein said magnetic toner has at least one endothermic peak in the temperature region of 110° C. or below in differential thermal analysis.

177. The method according to claim 161, wherein said magnetic toner contains a substance having at least one endothermic peak in the temperature region of 120° C. or below in differential thermal analysis.

178. The method according to claim 177, wherein said substance comprises a resin.

179. The method according to claim 178, wherein said resin comprises a polyester resin or silicone resin having a crystallizability.

180. The method according to claim 177, wherein said substance comprises a wax.

181. The method according to claim 180, wherein said wax comprises a wax selected from the group consisting of a polyolefin wax, a hydrocarbon wax, a petroleum wax and a higher alcohol.

182. The method according to claim 161, wherein said binder resin has, in its molecular weight distribution as measured by gel permeation chromatography, a main peak in a molecular weight region exceeding a molecular weight of 15,000.

183. The method according to claim 182, wherein said binder resin has a component having a molecular weight of not more than 10,000, in a content of 25% or less.

184. The method according to claim 161, wherein said binder resin has, in its molecular weight distribution as measured by gel permeation chromatography, a main peak in a molecular weight region exceeding a molecular weight of 15,000 and no peak or shoulder in a molecular weight region of not more than a molecular weight of 15,000, and has a component having a molecular weight of not more than 10,000, in a content of 25% or less.

185. The method according to claim 161, wherein said inorganic fine powder comprises silica, alumina, titanium or a double oxide thereof.

186. The method according to claim 161, wherein said magnetic toner particles have been made spherical by applying at least a mechanical impact.

187. The method according to claim 161, wherein; said magnetic toner is used together with a non-magnetic toner selected from the group consisting of a non-magnetic cyan toner, a non-magnetic yellow toner and a non-magnetic magenta toner, where color toner images having been primarily transferred onto said intermediate transfer member are secondarily transferred to said recording medium at one time to form a color toner image having the magnetic toner and non-magnetic color toners.

188. An image forming method comprising the steps of:

electrostatically charging an electrostatic latent image bearing member;

forming an electrostatic latent image on the electrostatic latent image bearing member thus charged;

developing the electrostatic latent image by the use of a magnetic toner carried on a toner carrying member, to form a toner image on the electrostatic latent image bearing member;

primarily transferring the toner image held on the electrostatic latent image bearing member, to an intermediate transfer member; and bringing a transfer member to which a voltage is applied, into contact with a recording medium to secondarily transfer to the recording medium the toner image held on the intermediate transfer member;

said magnetic toner comprising magnetic toner particles containing at least a binder resin and a magnetic material, and an inorganic fine powder, wherein;

said magnetic toner has at least one endothermic peak in the temperature region of 120° C. or below in differential thermal analysis;

said magnetic toner has, in its particles having particle diameters of 3 $\mu$m or larger, not less than 93% by number of particles having a circularity A of at least 0.90 and less than 30% by number of particles having a circularity $\dot{a}$ of at least 0.98, the circularity being found from the following expression (1):

$$\text{Circularity } \dot{a} = Lo/L \quad (1)$$

wherein Lo represents a circumferential length of a circle having the same projected area as a particle image, and L represents a circumferential length of a projected image of a particle; and said magnetic toner has a weight-average particle diameter of 8.0 Mm or smaller.

189. The method according to claim 188, wherein said electrostatic latent image has a potential contrast of 400 V or below.

190. The method according to claim 188, wherein said electrostatic latent image has a potential contrast of 350 V or below.

191. The method according to claim 188, wherein said electrostatic latent image bearing member comprises an electrophotographic photosensitive member.

192. The method according to claim 188, wherein a layer of said toner is formed on said toner carrying member by means of a toner layer thickness control member elastically touching the surface of said toner carrying member.

193. The method according to claim 188, wherein the surface of said electrostatic latent image bearing member has a contact angle to water, of 85 degrees or more.

194. The method according to claim 193, wherein said electrostatic latent image bearing member contains a fluorine-containing substance in its surface.

195. The method according to claim 194, wherein said fluorine-containing substance comprises a fluorine-containing fine powder.

196. The method according to claim 188, wherein said magnetic toner has a weight-average particle diameter from 3.0 $\mu$m to 8.0 $\mu$m.

197. The method according to claim 188, wherein said magnetic toner particles contain said magnetic material in a content from 30 to 200 parts by weight based on 100 parts by weight of the binder resin.

198. The method according to claim 188, wherein said magnetic toner has, in its particles having particle diameters of 3 $\mu$m or larger, a standard deviation SD of circularity distribution, of 0.045 or less as a value found from the following expression (2):

$$\text{Standard deviation } SD = \sqrt{\sum (a_i - \bar{a})^2 / (n-1)} \quad (2)$$

wherein $a_i$ represents a circularity of each particle, $\bar{a}$ represents an average circularity, and n represents the number of whole particles.

199. The method according to claim 198, wherein said magnetic toner has, in its particles having particle diameters of 3 $\mu$m or larger, a standard deviation SD of circularity distribution, of 0.040 or less.

200. The method according to claim 188, wherein said magnetic toner has at least one endothermic peak in the temperature region of from 60° C. to 120° C. in differential thermal analysis.

201. The method according to claim 188, wherein said magnetic toner has at least one endothermic peak in the temperature region of from 70° C. to 120° C. in differential thermal analysis.

202. The method according to claim 188, wherein said magnetic toner has at least one endothermic peak in the temperature region of 110° C. or below in differential thermal analysis.

203. The method according to claim 188, wherein said magnetic toner contains a substance having at least one endothermic peak in the temperature region of 120° C. or below in differential thermal analysis.

204. The method according to claim 203, wherein said substance comprises a resin.

205. The method according to claim 204, wherein said resin comprises a polyester resin or silicone resin having a crystallizability.

206. The method according to claim 203, wherein said substance comprises a wax.

207. The method according to claim 206, wherein said wax comprises a wax selected from the group consisting of a polyolefin wax, a hydrocarbon wax, a petroleum wax and a higher alcohol.

208. The method according to claim 188, wherein said binder resin has, in its molecular weight distribution as measured by gel permeation chromatography, a main peak in a molecular weight region exceeding a molecular weight of 15,000.

209. The method according to claim 208, wherein said binder resin has a component having a molecular weight of not more than 10,000, in a content of 25% or less.

210. The method according to claim 188, wherein said binder resin has, in its molecular weight distribution as measured by gel permeation chromatography, a main peak in a molecular weight region exceeding a molecular weight of 15,000 and no peak or shoulder in a molecular weight region of not more than a molecular weight of 15,000, and has a component having a molecular weight of not more than 10,000, in a content of 25% or less.

211. The method according to claim 188, wherein said inorganic fine powder comprises silica, alumina, titanium or a double oxide thereof.

212. The method according to claim 188, wherein said magnetic toner particles have been made spherical by applying at least a mechanical impact.

213. The method according to claim 188, wherein: said magnetic toner is used together with a non-magnetic toner selected from the group consisting of a non-magnetic cyan toner, a non-magnetic yellow toner and a non-magnetic magenta toner, where color toner images having been primarily transferred onto said intermediate transfer member are secondarily transferred to said recording medium at one time to form a color toner image having the magnetic toner and non-magnetic color toners.

* * * * *

UNITED STATES PATENT AND TRADEMARK OFFICE

CERTIFICATE OF CORRECTION

PATENT NO. : 6,033,817

DATED : March 7, 2000

INVENTOR(S) : HIROSHI YUSA, ET AL.

It is certified that error appears in the above-identified patent and that said Letters Patent is hereby corrected as shown below:

COLUMN 3:

Line 8, "on its lifetime." should read --in its lifetime.--;
Line 53, "may cause no" should read --will not cause--; and
Line 56, "less cause such" should read --cause less of such--.

COLUMN 4:

Line 11, "of;" should read --of:--; and
Line 27, "wherein;" should read --wherein:--.

COLUMN 8:

Line 67, "Parkin" should read --Perkin--.

COLUMN 10:

Line 7, "is" should read --are--.

COLUMN 12:

Line 54, "preferably" should read --preferbly be--.

UNITED STATES PATENT AND TRADEMARK OFFICE

CERTIFICATE OF CORRECTION

PATENT NO. : 6,033,817

DATED : March 7, 2000

INVENTOR(S) : HIROSHI YUSA, ET AL.

It is certified that error appears in the above-identified patent and that said Letters Patent is hereby corrected as shown below:

COLUMN 18:

Line 49, "unpreferably." should read --undesirably.--;
and
Line 66, "more" should read --further--.

COLUMN 19:

Line 34, "ozone less" should read --less ozone--.

COLUMN 20:

Line 67, "intermediaté" should read --intermediate--;
Line 68, "generates." should read --is generated--.

COLUMN 28:

Line 28, "A" should read --a--.

COLUMN 31:

Line 48, "(15g/cm)." should read
--(15g/cm).
Resin layer composition:--.

UNITED STATES PATENT AND TRADEMARK OFFICE

CERTIFICATE OF CORRECTION

PATENT NO. : 6,033,817

DATED : March 7, 2000

INVENTOR(S) : HIROSHI YUSA, ET AL.

It is certified that error appears in the above-identified patent and that said Letters Patent is hereby corrected as shown below:

COLUMN 33:

Line 33, "8A" should read --8--.

COLUMN 35:

Table 2, "Black Spots" should read --*1 Black Spots--;
Line 36, "evolution" should read --evaluation--; and
Line 37, "evalution" should read --evaluation--.

COLUMN 36:

Line 38, "wherein;" should read --wherein:--.

COLUMN 42:

Line 3, "an" should be deleted.

COLUMN 44:

Line 67, "Image" should read --image--.

COLUMN 50:

Line 26, "wherein;" should read --wherein:--;
Line 58, "A" should read --å--.

UNITED STATES PATENT AND TRADEMARK OFFICE

CERTIFICATE OF CORRECTION

PATENT NO. : 6,033,817

DATED : March 7, 2000

INVENTOR(S) : HIROSHI YUSA, ET AL.

It is certified that error appears in the above-identified patent and that said Letters Patent is hereby corrected as shown below:

COLUMN 51:

Line 2, "Mm" should read --μm--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*